US012187385B1

(12) United States Patent
Boden Candy

(10) Patent No.: US 12,187,385 B1
(45) Date of Patent: Jan. 7, 2025

(54) SHIP HULL AIR LUBRICATION SYSTEM FOAM RELEASE APPARATUS AND METHOD OF USE

(71) Applicant: GILES ENVIRONMENTAL LLC, Santa Ana, CA (US)

(72) Inventor: Giles Benjamin Boden Candy, Santa Ana, CA (US)

(73) Assignee: GILES ENVIRONMENTAL LLC, Santa Ana, CA (US)

( * ) Notice: Subject to any disclaimer, the term of this patent is extended or adjusted under 35 U.S.C. 154(b) by 0 days.

(21) Appl. No.: 18/803,150

(22) Filed: Aug. 13, 2024

Related U.S. Application Data

(60) Provisional application No. 63/532,591, filed on Aug. 14, 2023.

(51) Int. Cl.
*B63B 1/38* (2006.01)

(52) U.S. Cl.
CPC ..... *B63B 1/38* (2013.01); *B63B 2001/387* (2013.01)

(58) Field of Classification Search
CPC ..... B63B 1/38; B63B 2001/387
See application file for complete search history.

(56) References Cited

U.S. PATENT DOCUMENTS

| | | | | |
|---|---|---|---|---|
| 6,748,891 | B2 * | 6/2004 | Takahashi | B63B 1/38 114/67 A |
| 7,997,221 | B2 | 8/2011 | Costas | |
| 8,763,547 | B2 | 7/2014 | Costas | |
| 9,545,978 | B2 | 1/2017 | Johannesson | |
| 9,573,657 | B2 | 2/2017 | Johannesson | |
| 9,611,010 | B2 | 4/2017 | Kapteijn | |
| 10,315,729 | B2 | 6/2019 | McPherson | |
| 11,780,533 | B2 * | 10/2023 | Makiharju | B63B 1/38 114/67 A |
| 2010/0236466 | A1 | 9/2010 | Costas | |
| 2011/0259257 | A1 * | 10/2011 | Costas | B63B 1/38 114/289 |
| 2014/0030118 | A1 | 1/2014 | Costas | |
| 2022/0017182 | A1 | 1/2022 | Khreibani | |

FOREIGN PATENT DOCUMENTS

| | | | |
|---|---|---|---|
| WO | 2016137755 | A1 | 9/2016 |
| WO | 2022229054 | A1 | 11/2022 |

OTHER PUBLICATIONS

"Hull air lubrication with No. compressors" article featuring Armada ALS on p. 22 of TANKEROperator digital magazine, Jan.-Mar. 2023 edition, downloaded from www.tankeroperator.com on Apr. 1, 2023.

International Search Report and Written Opinion of the International Search Authority in PCT/US2024/042153 mailed Oct. 28, 2024.

* cited by examiner

*Primary Examiner* — Anthony D Wiest
(74) *Attorney, Agent, or Firm* — Master Key IP, LLP; Jeromye V. Sartain

(57) ABSTRACT

A foam release apparatus for use in conjunction with a vessel air lubrication system has a chamber intersected by and in fluid communication with the air lubrication system return pipe and one or more sloped release channels formed within the lower portion of the chamber opposite the return pipe chamber inlet, each release channel terminating in a respective release slot formed in the vessel hull so as to fluidly communicate between the chamber and the water boundary layer beneath the hull via the release channels and release slots.

20 Claims, 12 Drawing Sheets

SHIP HULL AIR LUBRICATION SYSTEM FOAM RELEASE APPARATUS AND METHOD OF USE

RELATED APPLICATIONS

This non-provisional patent application claims priority pursuant to 35 U.S.C. § 119 (e) to and is entitled to the filing date of U.S. Provisional Patent Application Ser. No. 63/532,591, filed Aug. 14, 2023, and entitled "Ship Hull Air Lubrication System Foam Release Apparatus and Method of Use." The contents of the aforementioned application are incorporated herein by reference.

BACKGROUND

The subject of this provisional patent application relates generally to ship hull air lubrication systems ("ALS"), and more particularly to a foam release apparatus downstream of the ALS foam generation device configured for improved release of the foam from and along the hull.

The following description includes information that may be useful in understanding the present invention. It is not an admission that any of the information provided herein is prior art or relevant to the presently claimed invention, or that any publication specifically or implicitly referenced is prior art.

Applicant hereby incorporates herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, "air lubrication" is a method of applying a layer of entrained air or air bubbles, also herein referred to as "foam," to the hull of a waterborne vessel or "ship" to reduce friction or resistance to movement. Over the years, such ship hull air lubrication systems ("ALS") have been installed on or adapted to a variety of waterborne vessels, from large commercial ships, work boats, and barges to small recreational boats. Generally, such ALS involve hardware and related control systems configured to cause the lubricating gas such as air to be combined with water to form a gas bubble and water foam as or once the air is released from the vessel generally along the underside of the hull so as to effectively form to some extent a reduced-friction boundary layer as the vessel moves through the water, reducing drag and improving efficiency. And with recent regulatory developments and general social and economic pressures, sailing more efficiently and systems that facilitate such are being developed with more focus and rigor, with ALS technology being one of a limited number of add-on hardware components that can significantly improve a vessel's carbon footprint. An ALS can either be installed on a new build vessel or retrofitted to an existing vessel.

Over the years, a variety of ALS have been proposed, all generally relating to the method or hardware by which the gas bubble and water foam is generated, whether on board or directly beneath the hull of the ship or other vessel.

For example, U.S. Pat. Nos. 7,997,221 and 8,763,547 to Costas et al. are both directed to an "Apparatus for Lowering Drag on a Moving Nautical Vessel." The '221 patent discloses an apparatus and method for reducing the drag that a vessel hull experiences when moving through the water by interposing air bubbles between the skin of the hull and the stream of water that the vessel is moving through, wherein compressed air is delivered to the bottom of the vessel without the need for a high energy air compressor. And the '547 patent discloses that rather than utilizing an air compressor or other external energy source, the compressed air is generated from the movement of the vessel and is released where needed in order to reduce drag on the vessel. In both cases, the gas bubble and water foam is effectively created at the point of discharge of air beneath the hull, not onboard the vessel prior to discharge.

U.S. Pat. Nos. 9,545,978 and 9,573,657 to Johannesson are both entitled "Air Lubrication System" and directed to a system for providing an air lubricating layer between a substantially flat bottom of a vessel and the water flowing under the bottom as the vessel is moving through the water, whereby the system includes sidewalls and a top wall defining a cavity with an opening situated in an interface plane that is transversal to the sidewalls, at the level of the flat bottom, the opening having a front end and a rear end seen in the length direction of the cavity, an air inlet spaced from the opening for introducing air into the cavity, whereby the length of the opening of the cavity is between 2 and 10 m and the distance of the top wall from the interface plane is between 0.2 m and 0.5 m. Fundamentally, in the Johannesson approach, the gas bubble (gas being air injected into the cavity) and water foam is created at the aft end of the cavity as the vessel moves forward. The small waves created on the surface created by the "wind" of the vessel's forward movement generating this entrainment of air flowing aft, down the hull. All of which is managed by a controller for operating the compressor depending on the speed and draft of the vessel and thus adding cost and complexity to the system. Disadvantageously, lower speeds or less "wind" entrain significantly less air.

U.S. Pat. No. 9,611,010 to Kapeijn is directed to "Reducing Drag of a Hull of a Ship" and discloses an apparatus for generating bubbles for reducing drag on a hull of a ship, wherein the bubble generating device is attachable to an outer surface of the hull, and wherein the apparatus comprises one or more microfluidic device for controlling a bubble size of the generated bubbles. Once again, such an approach thus disadvantageously involves creating any such gas bubble and water foam at the point of discharge beneath the hull, not onboard the vessel prior to discharge, which introduces a number of downsides and inefficiencies, starting with the use of a selectively controlled compressor for supplying compressed air to the external bubble-generating apparatus. Generating the bubbles at the point of air discharge means typically only a relatively thin layer of bubbles can be effectively created—otherwise the bubbles get too big or the air is discharged at too much pressure. In the case of Kapeijn "microfluidic" devices stretch across the entire width of the vessel, and in the case of Johannesson noted above the release cavities cover 35-40% of the width of the vessel. In both cases, these air outlets come with a significant installation burden.

More recently, in U.S. Patent Application Publication No. US 2022/0017182 A1 to Khreibani entitled "Ship Hull Air Microbubble Lubrication System" and filed Jul. 15, 2020, there is disclosed a ship hull microbubble system used to reduce frictional drag on a ship hull while traveling through water, which system includes a water pump connected to an ejector which in turn draws and compresses air within the ejector body. While in the ejector the compressed air becomes entrained within the pumped liquid as microbubbles creating a multiphase fluid which is then ejected at suitable pressure from the ship hull below the waterline through dedicated hull openings. The drawings in this patent application indicate no mechanism to generate "suitable pressure," noting the gas and air mixture downstream of an operating ejector is in hydraulic disconnect with the pump feeding water to the ejector. The ejected air liquid multiphase fluid then creates a plurality of microbubbles within the below water boundary layer reducing frictional drag generated by the hull as it travels through water. The disclosed system again includes independent control of the air injection rate as a means of controlling the generation and release of the foam or microbubbles and contains no disclosure regarding the hull openings other than a straight pipe intersecting the hull, which has disadvantages in operation and performance.

And in International PCT Patent Application Publication No. WO 2022/229054 A1 to Armson (Armada Technologies Limited) entitled "System and Method for Reducing Drag on a Marine Vessel" filed Apr. 25, 2022 with priority claim to Apr. 28, 2021, there is disclosed such a system as comprising a plurality of outlets provided in the hull of the vessel for delivering a layer of air bubbles between at least a portion of the hull and the water; at least one venturi tube adapted to supply air and water to one or more of said plurality of air outlets; at least one seawater inlet located in the bow region of the vessel adapted to give a "passive" supply of seawater to the at least one venturi tube as the vessel moves through the water; at least one seawater pump adapted to supply seawater to the at least one venturi tube; at least one ambient air inlet port adapted to supply ambient air to the at least one venturi tube such that ambient air is entrained into sea water flowing through the at least one venturi tube; a compressor supplying compressed air to the at least one venturi tube; a controller adapted to regulate the flow rate of sea water supplied from the at least one seawater pump and to regulate the supply of compressed air from the compressor to optimize the delivery of air bubbles through the plurality of outlets in the hull and thereby optimize drag reduction of the vessel. Once more, such a system involves additional complexity and cost through its reliance on a controller and related hardware here to regulate the supply of both sea water and compressed air in generating the air bubbles or foam.

Finally, in U.S. Pat. No. 10,315,729 to McPherson filed Nov. 30, 2017 with priority claim to Nov. 30, 2016 and granted Jun. 11, 2019, there is disclosed a "Ship Hull Microbubble System" adapted to reduce drag on a ship hull traveling through water. The ship hull microbubble system includes a ballast pump, mechanically coupled to a ballast main pipe. A venturi injector is joined to the ballast main pipe with a riser pipe. A discharge pipe is joined to the venturi injector and further piercing the ship hull. An air water mixture is formed when water pulled into the ballast pump and driven to the venturi injector receives air from the venturi injector. Discharging the air water mixture through the discharge pipe creates a plurality of microbubbles against the ship hull that reduces the drag on the ship hull when travelling through water.

What has been needed and heretofore unavailable is improved hardware downstream of the foam generation portion of the Air Lubrication System ("ALS") for static control of foam release to the hull and thus more reliable and efficient and less expensive and complex operation of the ALS. Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a new and beneficial foam release apparatus configured for operational installation on a waterborne vessel in conjunction with the vessel's air lubrication system ("ALS"). In at least one embodiment, the apparatus comprises a chamber intersected by and in fluid communication with the ALS return pipe and having one or more sloped release channels formed within the lower portion of the chamber somewhat opposite of the ALS return pipe chamber inlet, each release channel terminating in a respective release slot formed in or intersecting the vessel hull so as to fluidly communicate between the chamber and the water boundary layer beneath the hull via the release channels and release slots.

In another aspect, the geometry or configuration of the static or steady state foam release apparatus downstream of the venturi injector of the ALS is sized relative to the ALS for optimal foam discharge from the hull outlets, or essentially having the rate of release of the foam somewhat match the expected speed of the vessel and the angle of release of the foam be more along the bottom of the vessel, resulting in a relatively more laminar foam release so as to improve the operation of the ALS and thus the efficiency of the vessel.

In yet another aspect, characteristics that are considered when determining the geometry or configuration of the solid state foam release apparatus are vessel specific, including but not limited to the rate of foam produced, which in turn is determined by the water pump(s) used and the effective height of the venturi injector installation, the draft of the vessel, the volume of foam available for release, which is a fraction of the volume of foam produced and is directly proportional to the draft of the vessel, the sailing state of the vessel (in cargo and in ballast), and the normal speed range of the vessel.

In still another aspect, for an individual vessel such variables as noted above can be specified to specific values or ranges of values, and the consideration of this information allows for the configuration of the foam release apparatus and specifically the total cross-sectional area of the release channels to determine the release velocity of the foam that is to be approximately matched to the expected velocity of the vessel.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
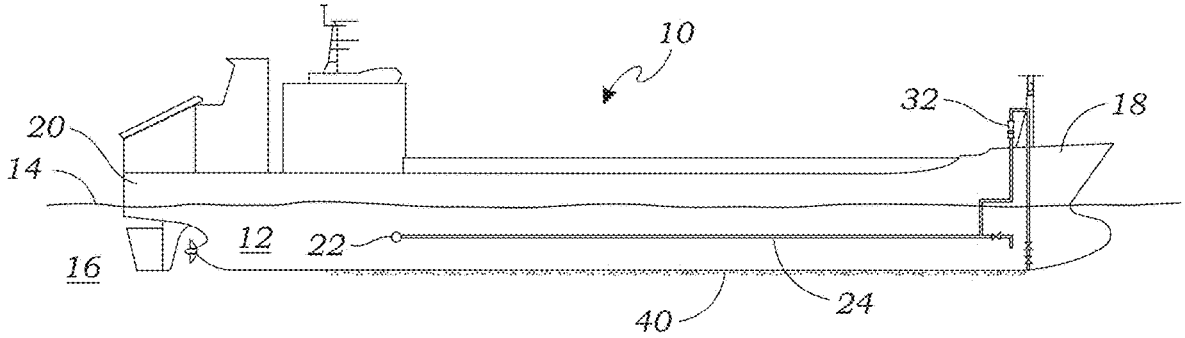
FIG. 1 (PRIOR ART)
FIG. 1 is a side schematic view of an exemplary prior art vessel equipped with an air lubrication system ("ALS")

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of an apparatus according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of any appended claims.

Figure 2:
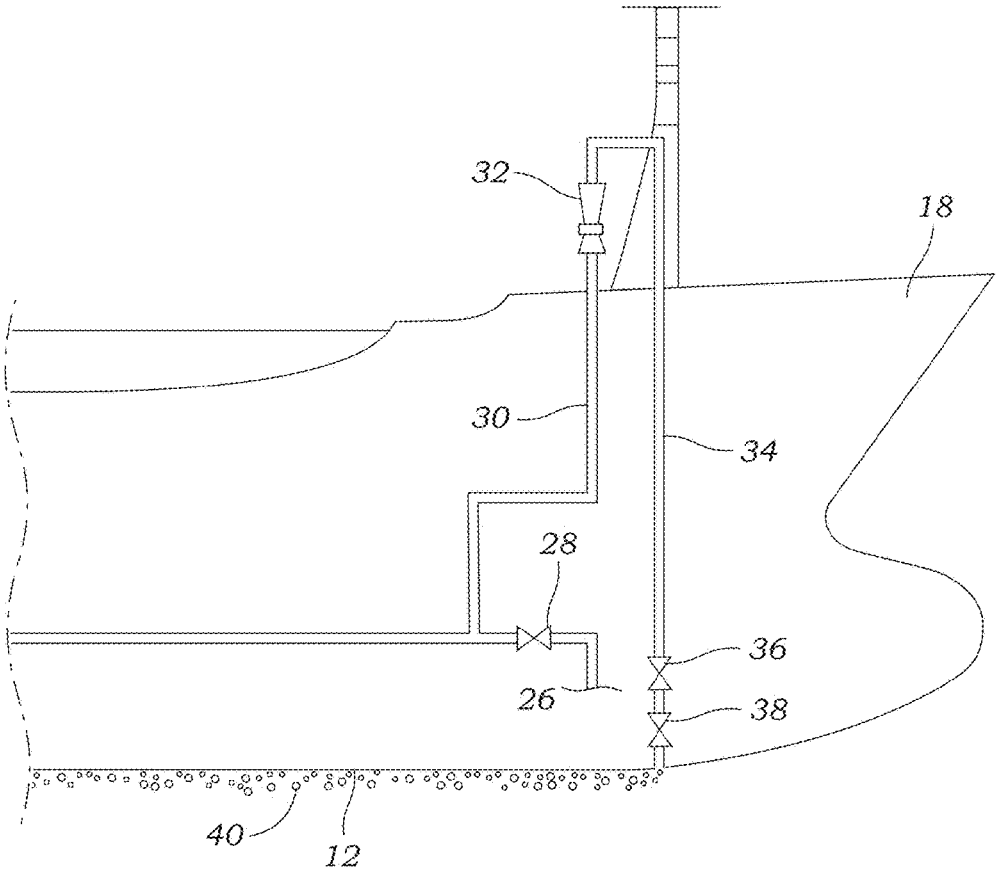
FIG. 2 (PRIOR ART)
FIG. 2 is an enlarged partial side schematic view thereof.
Figure 3:
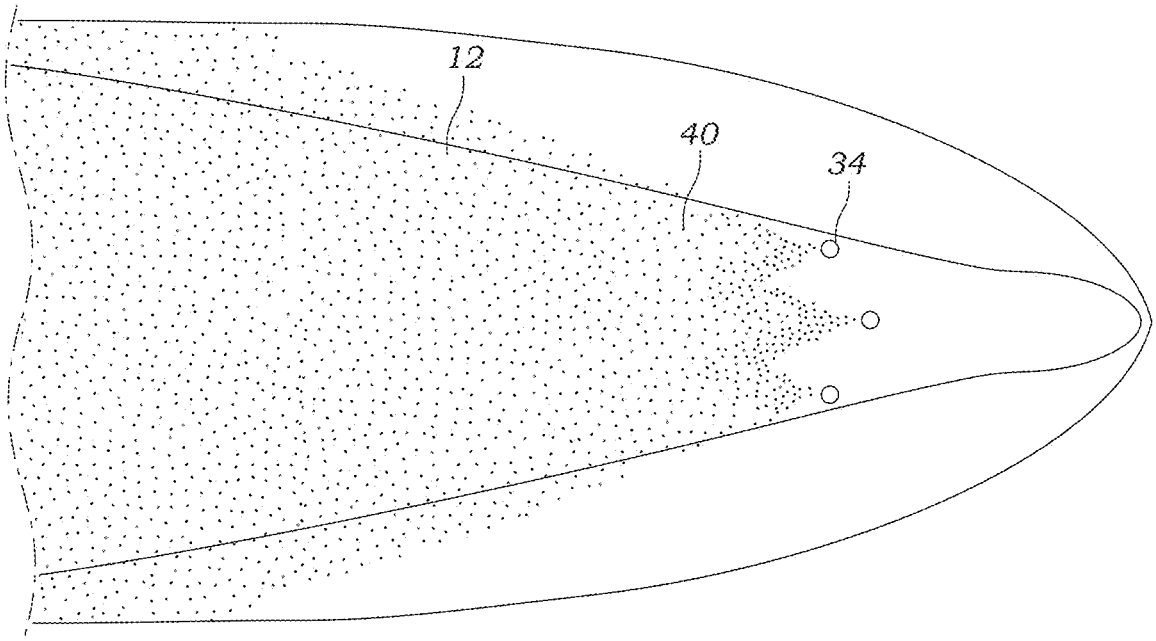
FIG. 3 (PRIOR ART)
FIG. 3 is an enlarged partial bottom schematic view thereof.

Referring first to FIGS. 1-3 disclosing an exemplary prior art vessel equipped with an air lubrication system ("ALS") 10 such as disclosed in U.S. Pat. No. 10,315,729 to McPherson, incorporated herein by reference, one embodiment of the ship hull microbubble system 10 comprises a ship hull 12 at least a portion of which extends below a waterline 14 when the ship hull 12 is placed in water 16. The ship hull 12 further comprises a bow 18 in a forward direction and a stern 20 in an aft direction using the convention common in naval architecture. A ballast pump 22 is mechanically coupled to a ballast main pipe 24 which is further connected to a forward peak tank 26 with a forward peak tank valve 28, though it will be appreciated that such forward peak tank 26 and valve 28 are optional and merely illustrative and that other ALS 10 will not necessarily include such devices. The ballast main pipe 24 is further mechanically coupled to a riser pipe 30. Above the ship hull 12, the riser pipe 30 is attached to a venturi injector 32 which is further attached to a return pipe 34 that pierces the ship hull 12. The return pipe 34 is attached to a first hull shut off valve 36 and potentially a second hull shut off valve 38. When the forward peak tank valve 28 is closed the ballast pump 22 pulls water 16 from outside the ship hull 12 into the riser pipe 30. From there the water 16 becomes aerated with air from the venturi injector 32 that creates an air water mixture further comprising microbubbles 40. The air water mixture further comprising the microbubbles 40 is then simply pushed beneath the ship hull 12 via the exit in the hull 12 where it is intersected by the return pipe 34, allowing the microbubbles 40 to somewhat form a boundary layer along the bottom of the hull 12, which it will be appreciated makes it relatively easier for the vessel to travel since air is less dense than water; that is, the air water mixture is less dense than the water otherwise would be, and also the surface tension of the foam is less than water, therefore less energy is required for the vessel to move through/over the air water mixture and thus the water 16.

Figure 4:
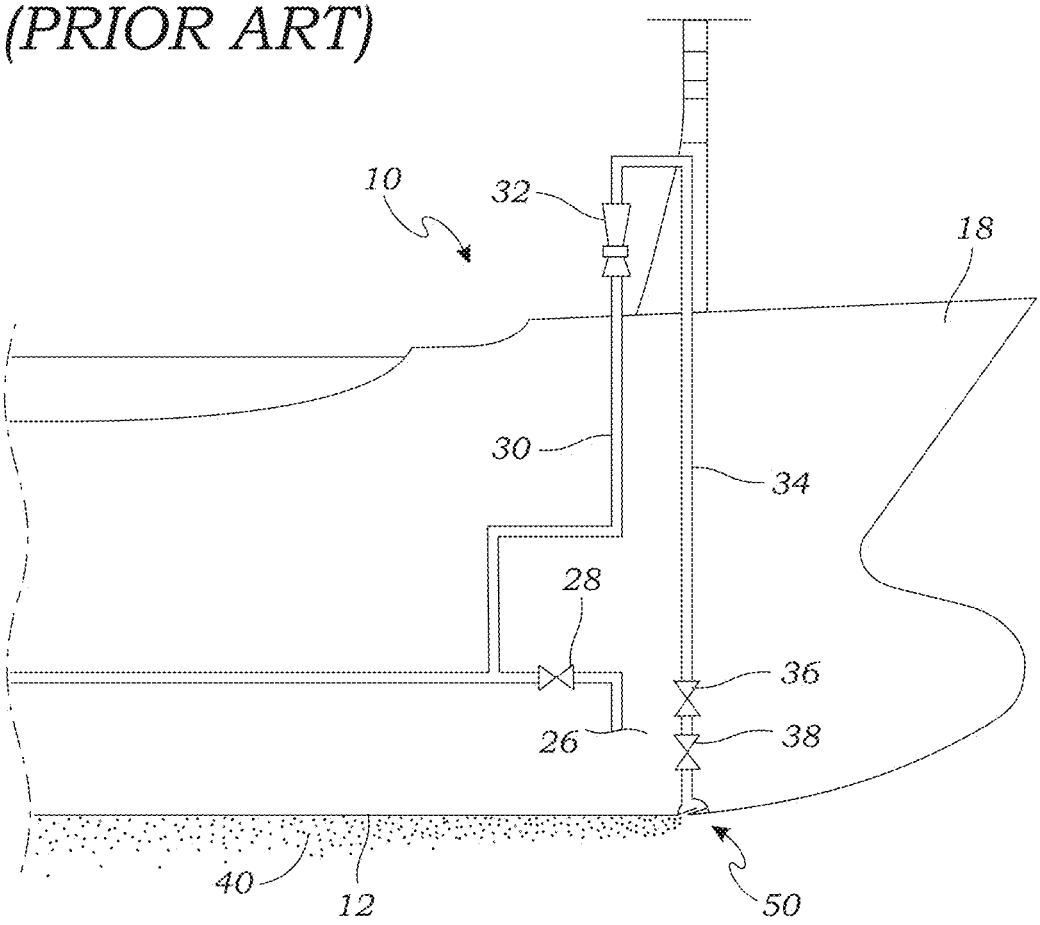
FIG. 4 is a partial side schematic view of an exemplary vessel equipped with an exemplary ALS foam release apparatus, in accordance with at least one embodiment.
Figure 5:
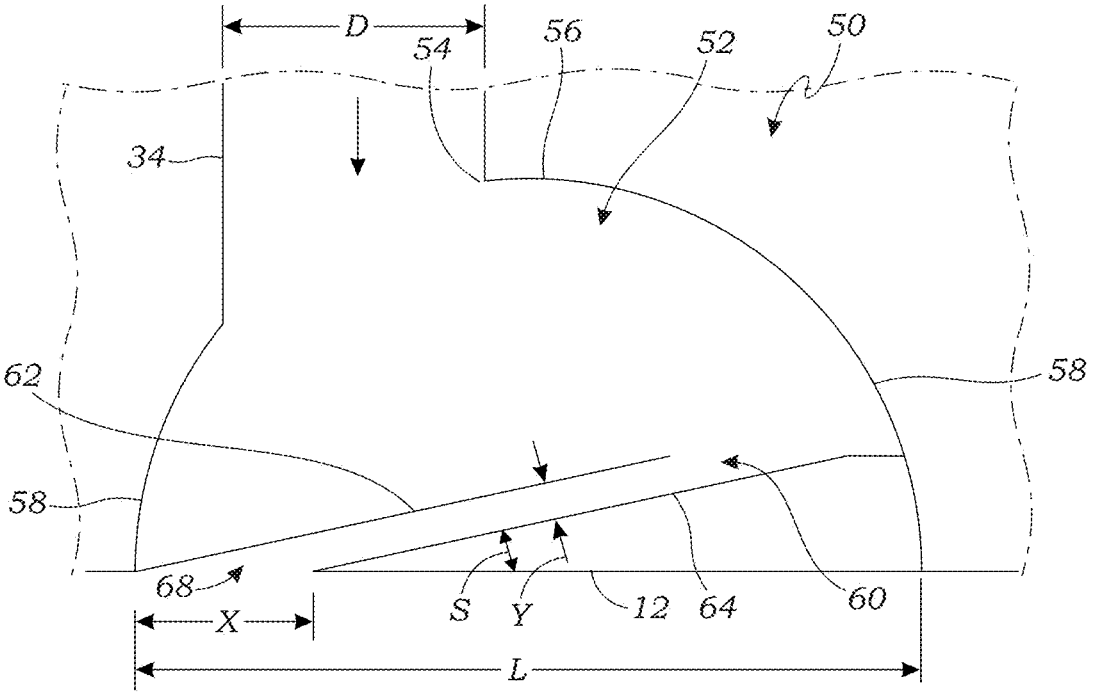
FIG. 5 is an enlarged partial side schematic view thereof, in accordance with at least one embodiment.
Figure 6:
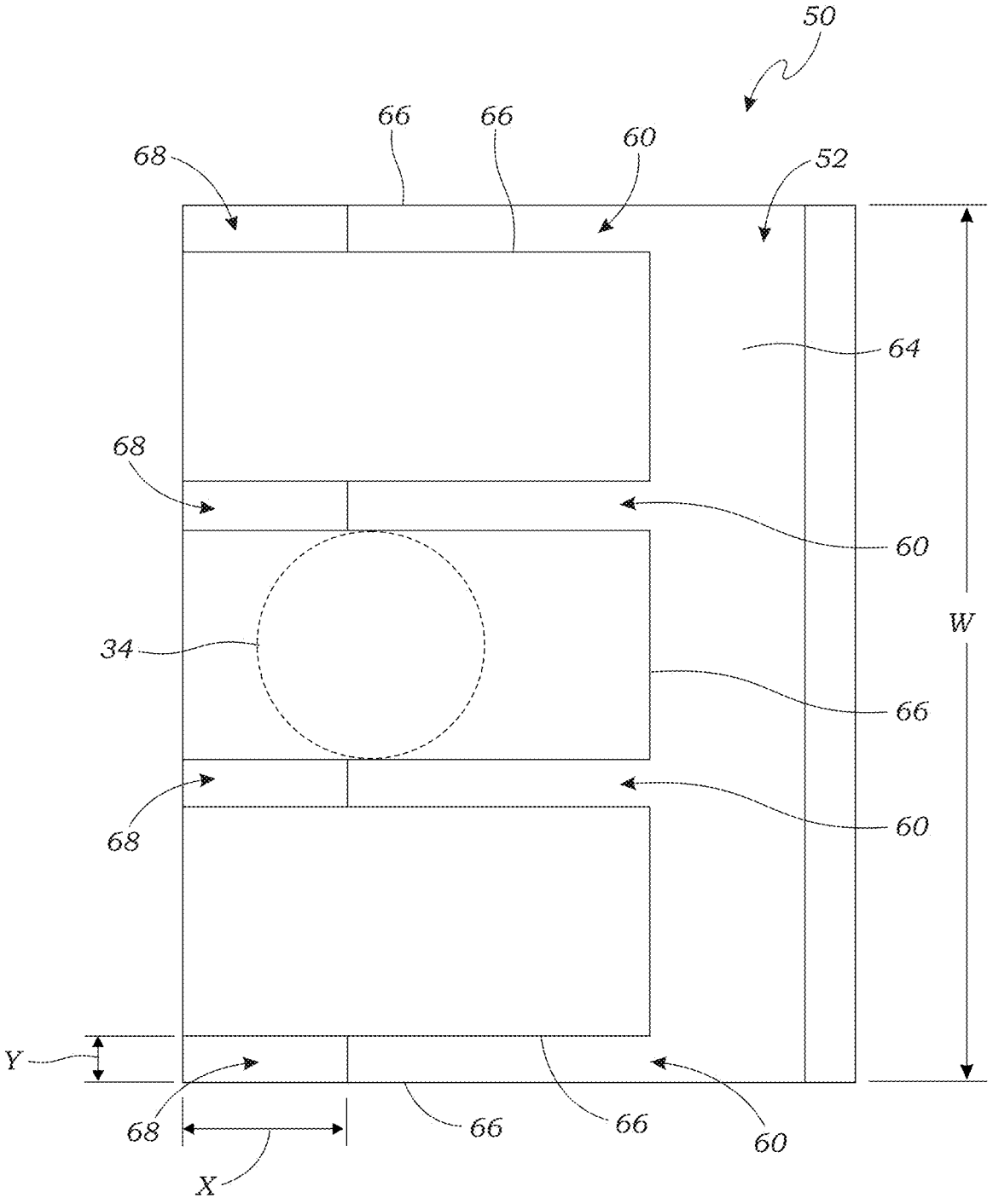
FIG. 6 is an enlarged partial top schematic view thereof, in accordance with at least one embodiment.

Turning now to FIGS. 4-6, there are shown partial side and top schematic views of an exemplary embodiment of a foam release apparatus 50 according to aspects of the present invention as incorporated in an exemplary prior art air lubrication system 10 operationally installed on a vessel. The apparatus 50 comprises, in the exemplary embodiment, a chamber 52 intersected by and in fluid communication with the ALS return pipe 34 at an upper chamber inlet 54 formed in the upper wall 56 of the chamber 52 and a plurality of sloped release channels 60 formed within the lower portion of the chamber 52 somewhat opposite of the ALS return pipe chamber inlet 54, each release channel 60 terminating in a respective release slot 68 formed in or intersecting the vessel hull 12 so as to fluidly communicate between the chamber 52 and the water 16 beneath the hull 12 via the release channels 60 and release slots 68. Accordingly, it will be appreciated that the gas or air bubble and water mixture or foam generated by the upstream venturi injector 32 that passes down through the return pipe 34 to the foam release apparatus 50 and specifically the chamber 52, or the volume represented by the chamber 52, via its inlet 54 can then stabilize or be conditioned or slowed down pre-release within the chamber or volume 52 before the foam then passes out of the chamber 52 through the release channels 60 and release slots 68 to the bottom of the hull 12 so as to form the desired air-water microbubble boundary layer 40 for reduced drag and improved vessel efficiency. While such an improved foam release apparatus 50 according to aspects of the present invention is shown and described in connection with a prior art air lubrication system 10 as per U.S. Pat. No. 10,315,729 to McPherson, it will be appreciated that such foam release apparatus 50 may be incorporated into or employed in conjunction with any air lubrication system or the like now known or later developed as involving the on-board generation of foam that is to then be discharged or released beneath the vessel hull, such that incorporation of such a foam release apparatus 50 according to aspects of the present invention in the exemplary prior art air lubrication system 10 is to be understood as illustrative and non-limiting. Following U.S. Pat. No. 10,315,729 and other such ALS where an air bubble and water foam is generated upstream of the release point of the foam from the hull 12, and as an improvement thereover, it is to the benefit of the overall ALS 10 that the release of foam is conditioned to suit the expected sailing speed(s) and draught(s) of the vessel. Where there is an upstream generation of the foam, its quality and volume can be separated somewhat from the overall performance of the ALS if the transfer and release of the foam is suitably controlled. At a high level, according to aspects of the present invention, beneficially, application of hardware in a foam release apparatus 50 such as shown and described to control the release of foam from the vessel employs static equipment that is not modified or moved during operation of the ALS 10, reducing the cost and complexity of the overall ALS 10, it being appreciated that active or movable control of the characteristics (geometry) of the foam release apparatus 50 and the release channels 60 and slots 68 specifically may be possible, however, this would bring complexity and cost to the ALS as well as inevitable reliability issues, as the underside of a ship hull is a harsh environment for an articulated system. Aspects of the present invention are directed to a foam release apparatus 50 having solid state hardware that is specifically designed for the operational specification of a particular vessel to maximize the performance of its ALS 10, meaning that such apparatus 50 is a static device with no moving parts and no dynamic or control system-based operation, and specifically not being reliant on control of a pump or compressor for effective operation of the inventive foam release apparatus 50 as part of the ALS 10. Such apparatus 50 hardware or geometry can then be sized or scaled based on the location of foam generation, the quality of the foam generated, and the physical and operational characteristics of the vessel the ALS 10 and related foam release apparatus 50 is installed on. Ultimately, the reason it is important to condition the release of a pre-generated foam from an ALS 10 is that while an unconditioned release of foam under the hull 12 of the vessel may allow some air lubrication benefit to the vessel, it can also increase turbulence and drag on the vessel. Correct or controlled conditioning of and even somewhat laminar foam release will optimize the benefit of air lubrication for a given foam and a given vessel.

Figure 7:
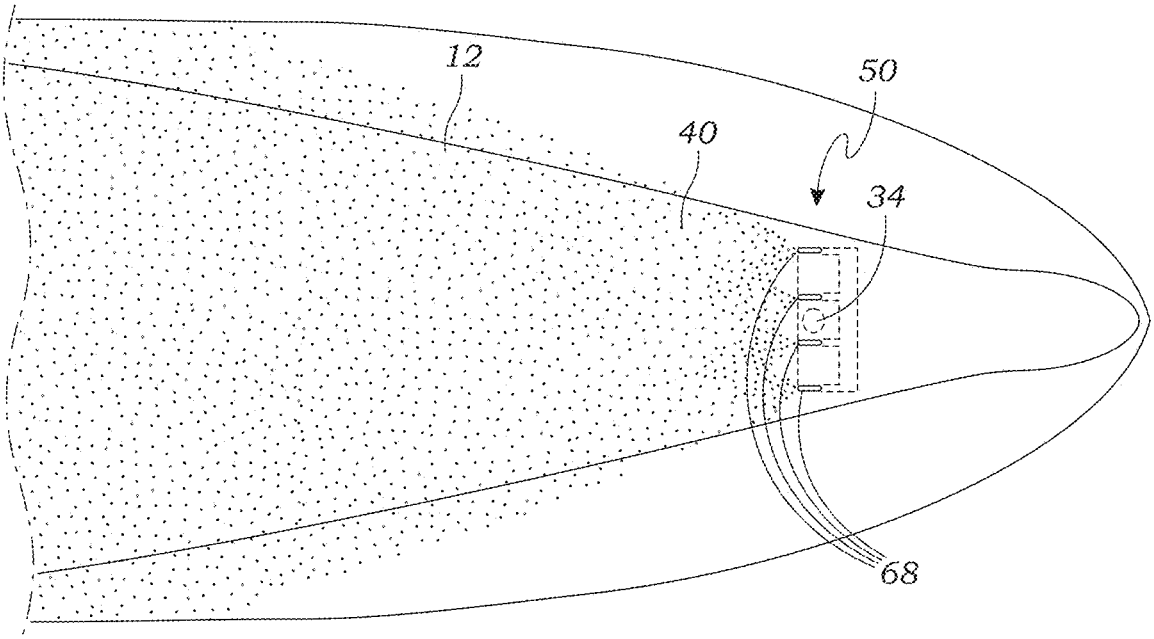
FIG. 7 is an enlarged partial bottom schematic view thereof, in accordance with at least one embodiment.

In a bit more detail with continued reference to FIGS. 5 and 6, the exemplary foam release apparatus 50 again includes a chamber 52 defined or bounded above and forwardly and rearwardly by upper and side walls 56, 58, respectively, and below effectively by the release channel lower plate 64 spaced from and intersecting the vessel hull 12 and laterally by the release channel side plates 66. The upper plate 62, not shown in FIG. 6 for simplicity, the lower plate 64, and the vertical side plates 66 together form the respective release channels 60 that communicate between the chamber 52 and the release slots 68 formed where the release channels 60 intersect the hull 12 as openings for the controlled release of foam from the chamber 52. Again, the foam enters the chamber 52 from the upstream air lubrication system 10, and its venturi injector 32 specifically, via the return pipe 34 that communicates with the chamber 52 via the inlet 54 in the chamber upper wall 56. Once more, it will be appreciated that such a foam release apparatus 50 according to aspects of the present invention can take a number of other forms and be scaled or sized to suit various ALS 10 and vessels without departing from the spirit and scope of the invention. By way of illustration and not limitation, in one exemplary foam release apparatus 50 according to aspects of the present invention such as shown in FIGS. 4-7, the return pipe 34 may have a nominal diameter D of 200 mm and the overall length L of the chamber 52 from the base of the forward or bow side plate 66 to that of the rear or stern side plate 66 may be 900 mm. If the lateral width W of the chamber 52 is 2,000 mm, for example, and taking the continuous chamber top and side walls to form a semi-circular width-wise or transverse profile of the chamber 52, it follows that the volume of the chamber 52 in this example is nominally 636,170,000 $mm^3$ ($V=(\pi(900\ mm)^2\times1{,}500\ mm)/8$), which translates to 0.64 $m^3$ or about 636 liters, including the release channels 60, though not accounting for the sloped lower plate 64. It will be appreciated that such volume in the absolute sense or relative to the ALS 10 and particularly the size of the venturi injector 32 and return pipe 34 thus allows for slowing and conditioning of the foam pre-release from the chamber 52 and particularly the release slots 68 via the release channels 60. And continuing with the illustrative apparatus 50 sized as set forth above, the release channel 60 profile or cross-section Y as defined by the upper, lower, and side plates 62, 64, 66 may be nominally 100 mm in both width and height, with the upper and lower plates 62, 64 and thus the release channel 60 being at a slope or angle S to the bottom of the hull 12 nominally of ten to twenty degrees (10-20°), such that the length X of the release slot 68 is then approximately 200 mm and is still nominally 100 mm wide, based on the slanted intersection of the release channel 60 with the hull 12. In the industry, common sizes of venturi injectors 32 and thus feed pipes 34 are in the range of 150-600 mm pipe diameter, selected based on pumping rate and pressure and other factors. The main pipe 24 from the ballast pump 22 will generally be sized to a water velocity of up to 3 m/sec, such that for example a volumetric flow rate of 340 $m^3$/hr would call for a 200 mm diameter venturi 32 and pipe 34. Ballast flow through standard pipe sizes are thus what determines the volume of foam generated via the venturi injector 32 at the deck. At relatively high pressure such as might be the case for a ballast pump rating and setup for a relatively small vessel such as a work boat, the typical venturi injector will educt two times (2×) air to water, whereas in other examples such as set forth further below as might be the case with relatively larger, lower pressure ballast systems on relatively larger ships such as tankers, the typical venturi injector 32 will educt more like one-and-a-third times (1.3×) air to water. To continue with exemplary hard numbers for the illustrated small vessel air lubrication system 10 and related inventive foam release apparatus 50, the volume of foam generated per hour at the deck level consists of 250 $m^3$ of water plus 500 $m^3$ of air or nominally a total of 750 $m^3$/h at atmospheric pressure. The release point of the foam is the draft of the vessel, such as 6 m below the surface 14 when the vessel is in ballast. The pressure at 6 m of water is 1.6 atmospheres A (Absolute), so the 500 $m^3$ of air is now reduced due to the water pressure under the hull 12: 500/1.6=312 $m^3$. Adding the 250 $m^3$ of water and the total volume of foam produced and to be discharged is 562 $m^3$/hr. While in cargo the draft is nominally 7 m and thus the pressure of water is 1.7 atmospheres A (Absolute), so the volume of air is 500/1.7=294 $m^3$ plus 250 $m^3$ of water or 544 $m^3$ of foam produced and to be released under the hull 12 per hour. Taking the nominal volume of the foam release apparatus chamber 52 to again be 0.64 $m^3$ in this example, it follows that the roughly 550 $m^3$/hr (or 0.15 $m^3$/sec) of foam created and discharged by the venturi injector 32 translates to the foam dwelling within the foam release apparatus chamber 52 for about four seconds prior to discharge from the release slots 68 based on such foam creation and volumetric flow rates (0.64 $m^3$/0.15 $m^3$/sec). Of course, this is a bit of an over-simplification and is again based on illustrative round numbers, but the point is made and the benefit of such a foam release apparatus 50 will be readily understood and appreciated by those skilled in the art, though it should also to be appreciated that any such dwell or residence time of the foam within the chamber or volume 52 may vary based on a number of factors, principally including but not limited to the size or volume of the chamber 52 itself or the space between the return pipe 34 and the release channels and slots 60, 68, such that the indicated approximately four-second dwell of the foam within the chamber 52 prior to discharge is to be understood as merely illustrative and non-limiting, and that indeed in other embodiments or contexts a dwell time of one second or less may be appropriate and the foam release apparatus 50 sized or scaled accordingly. Furthermore, the foregoing regarding any dwell and the resulting more controlled discharge or release of foam beneath the vessel hull 12 from the release slots 68 does not account for some of the other physical and fluid dynamics factors at work within the apparatus 50 such as frictional effects and, in the exemplary embodiment of FIGS. 4-7, the somewhat circuitous or indirect path the foam would take by entering the chamber 52 from the return pipe 34 aft and traveling forward along and up the sloped release channel upper plate 62 to exit the chamber 52 through the sloped release channels 60. In terms of fluid velocities, taking the vessel speed in ballast to be 9 knots or 4.5 m/sec and the vessel speed in cargo to be 8 knots or 4 m/sec, it follows that such would be the approximate velocities at which the foam would be released from the release slots 68 for a consistent relatively laminar flow across the bottom of the hull 12. Taking again the volume of foam produced and thus to be released to be in this example 0.15 $m^3$/sec, it follows that the cross-sectional area through or across which such foam would be released at the desired velocity of 4-4.5 m/sec would be approximately 0.035 $m^2$ (0.15 $m^3$/sec/4.25 m/sec), which corresponds to the illustrated example wherein each of the four release channels 60 has a nominal profile or cross-section of 100 mm×100 mm, which equates to 10,000 $mm^2$ or 0.01 $m^2$, there thus being four release channels 60 having a nominal total cross-sectional area of 0.04 $m^2$ (4×0.01 $m^2$). The result as shown in both FIGS. 4 and 7 is a relatively uniform or consistent and even somewhat laminar discharge from the release channels 60 and slots 68 of foam or air-water microbubbles 40 along the vessel hull 12, with the aft foam release velocity substantially corresponding to the expected or representative vessel speed, whether in ballast or in cargo, such as an average of 4.25 m/sec in this example. Ultimately, in any and all such versions of a foam release apparatus 50 "right-sized" for a particular vessel and its expected sailing parameters, the representative vessel speed for purposes of sizing or configuring particularly the release channel(s) 60 may be taken to be any desired or suitable vessel speed, whether high or low or average or as a percent or proportion of any such anticipated vessel speed(s). Once again, those skilled in the art will appreciate that a variety of other sizes and configurations of such a static or solid state foam release apparatus 50 according to aspects of the present invention may be employed based on a number of factors without departing from the spirit and scope of the invention, as will be further appreciated from the following alternative non-limiting example.

Figure 8:
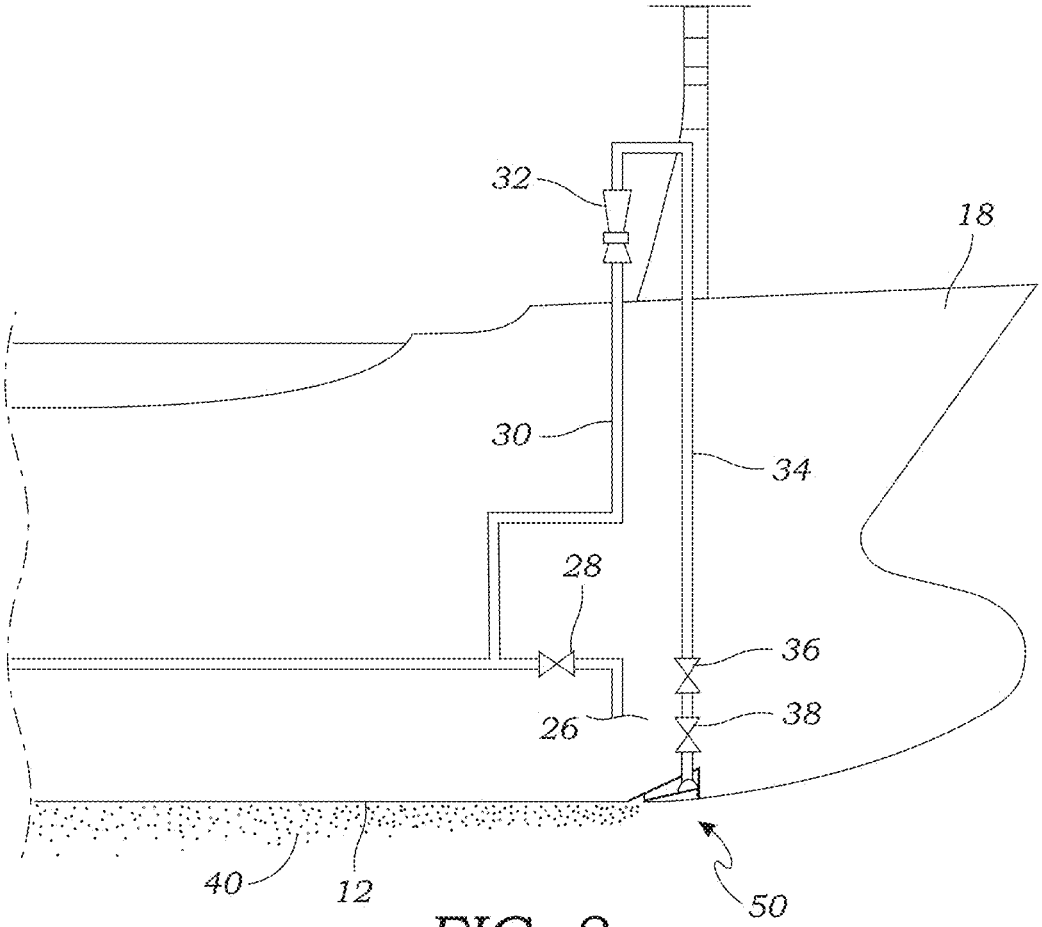
FIG. 8 is a partial side schematic view of an exemplary vessel equipped with an alternative exemplary ALS foam release apparatus, in accordance with at least one embodiment.
Figure 9:
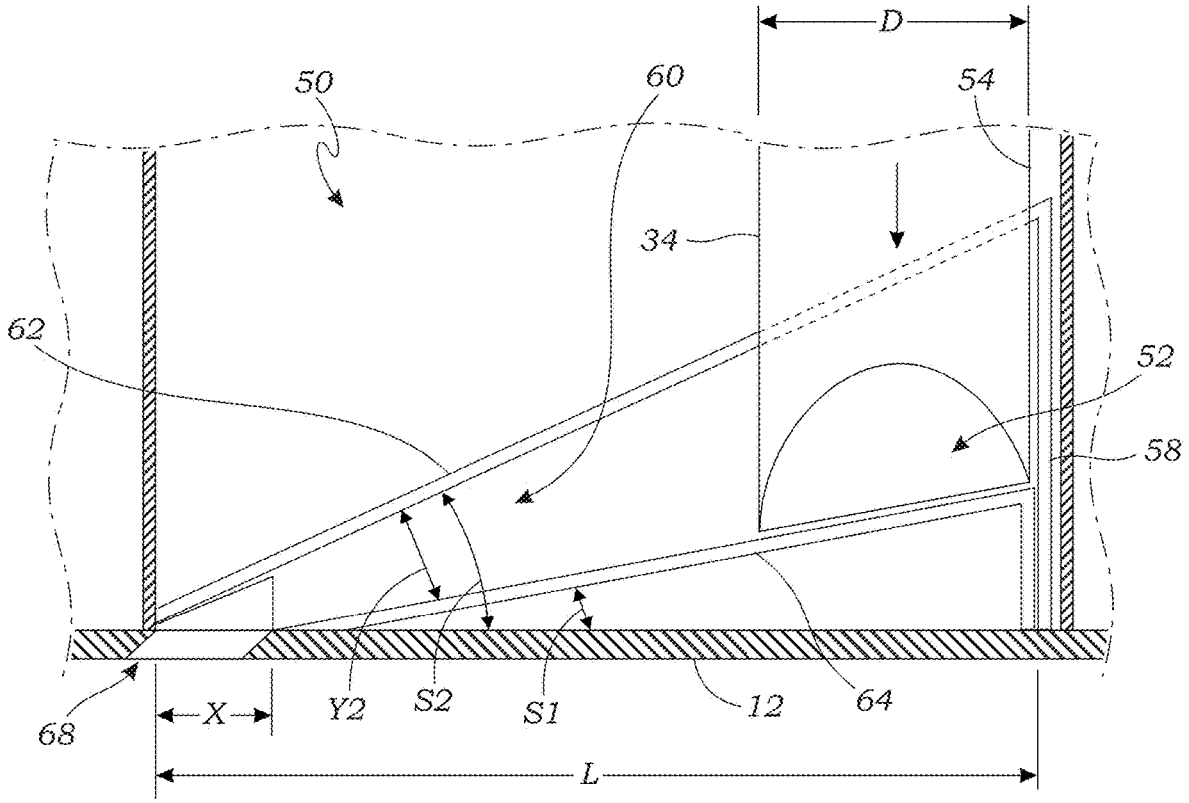
FIG. 9 is an enlarged partial side schematic view thereof, in accordance with at least one embodiment.
Figure 10:
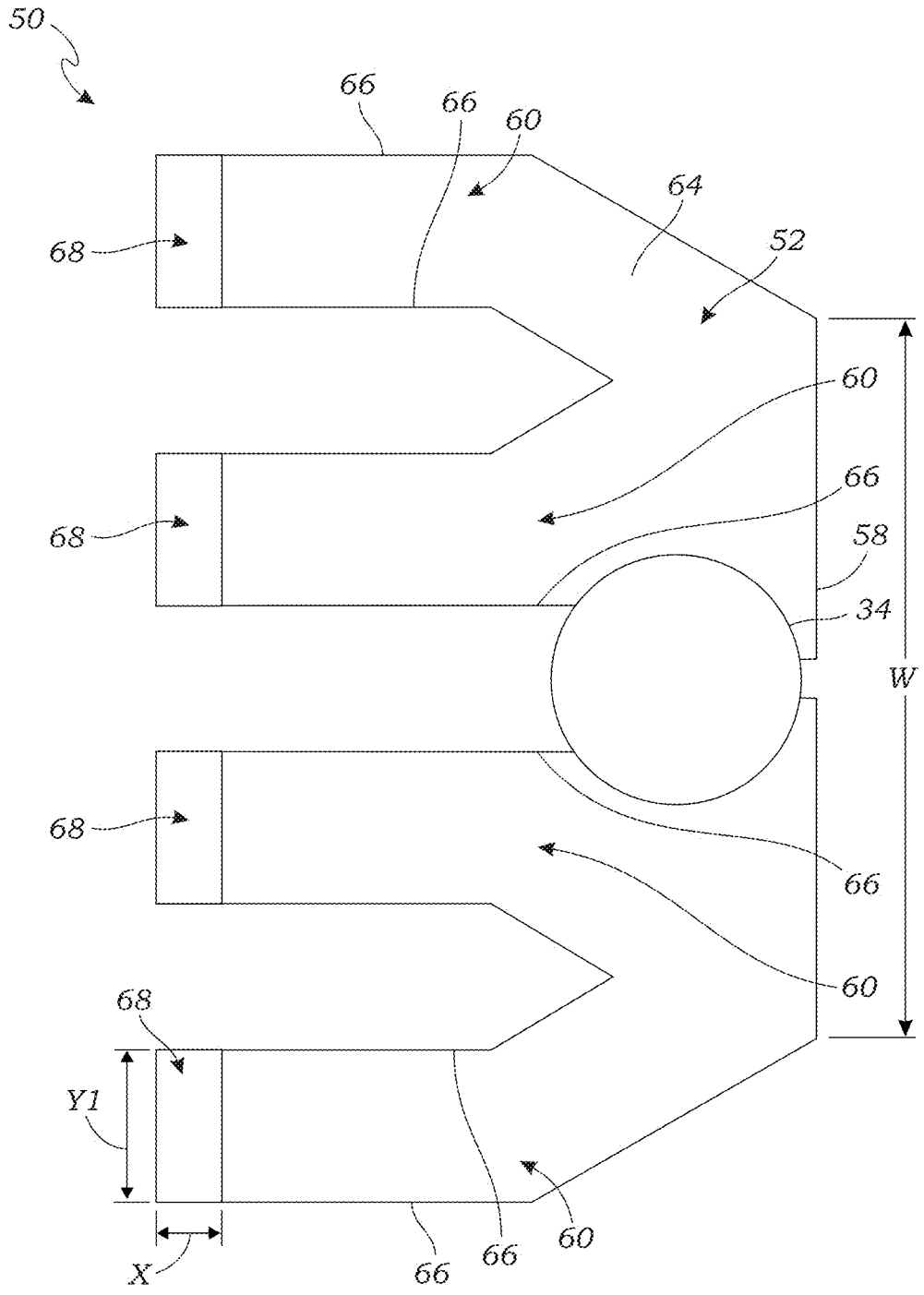
FIG. 10 is an enlarged partial top schematic view thereof, in accordance with at least one embodiment.
Figure 11:
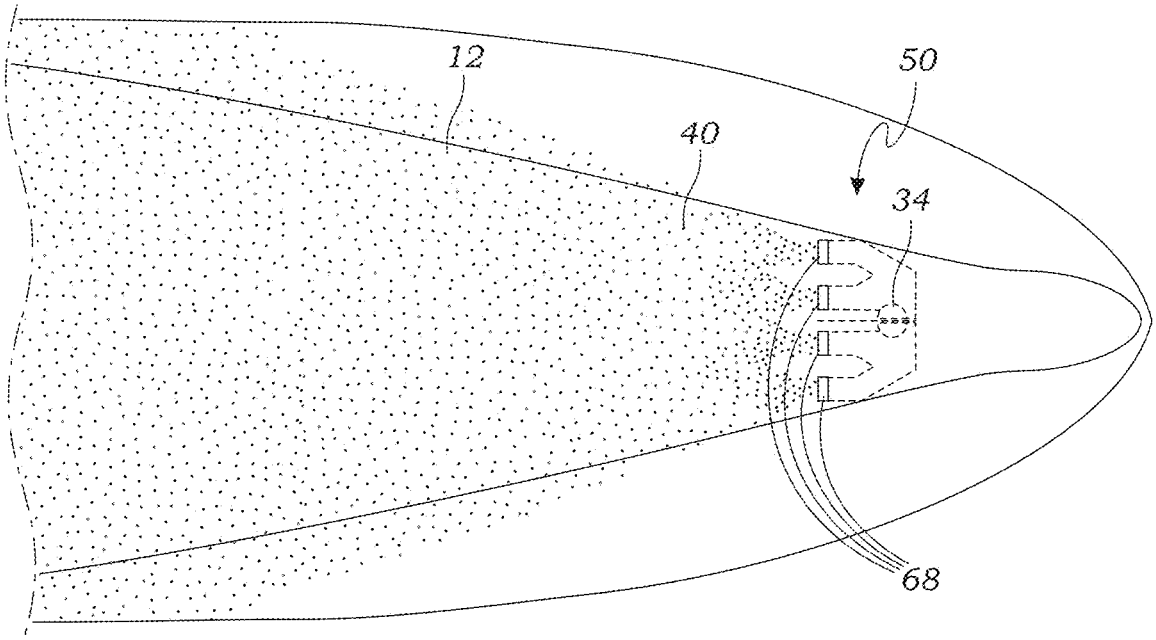
FIG. 11 is an enlarged partial bottom schematic view thereof, in accordance with at least one embodiment.

Referring next to FIGS. 8-11, there are shown partial side, top, and bottom schematic views of an alternative exemplary embodiment of a foam release apparatus 50 according to aspects of the present invention as incorporated in an exemplary prior art air lubrication system or ALS 10 operationally installed on a vessel, with the exemplary prior art ALS 10 of U.S. Pat. No. 10,315,729 to McPherson again to be understood as illustrative and non-limiting. The apparatus 50 once more comprises a chamber 52 intersected by and in fluid communication with the ALS return pipe 34, though here the chamber upper wall 56 and the release channel upper plate 62 are contiguous, with the return pipe 34 passing through the upper plate 62 defining the upper chamber inlet 54. Even so, the overall chamber 52 perimeter still is bounded or defined at its bottom by the release channel lower plate 64 and vertically by at least one side wall 58. A plurality of sloped release channels 60 are once again formed within the chamber 52, each release channel 60 bounded or defined by the upper plate 62, not shown in FIG. 10 for simplicity, the lower plate 64, and the vertical side plates 66 and terminating in a respective release slot 68 formed in or intersecting the vessel hull 12 so as to fluidly communicate between the chamber 52 and the water 16 beneath the hull 12 via the release channels 60 and release slots 68 defining openings for the controlled release of foam from the chamber 52. Accordingly, it will again be appreciated that the gas or air bubble and water mixture or foam generated by the upstream venturi injector 32 that passes down through the return pipe 34 to the foam release apparatus 50 and specifically the chamber 52 via its inlet 54 can then stabilize or be conditioned pre-release through a holding or dwell time within the chamber 52 before the foam then passes out of the chamber 52 in a relatively controlled manner through the release channels 60 and release slots 68 to the bottom of the hull 12 so as to form the desired air-water microbubble boundary layer 40 for reduced drag and improved vessel efficiency. Once more, it will be appreciated that such a foam release apparatus 50 according to aspects of the present invention can take a number of other forms and be scaled or sized to suit various ALS 10 and vessels without departing from the spirit and scope of the invention. By way of further illustration and not limitation, now taking for example a larger tanker or other ship as the vessel on which the ALS 10 is installed, in one exemplary foam release apparatus 50 according to aspects of the present invention such as shown in FIGS. 8-11, the venturi injector 32 and return pipe 34 may have a nominal diameter D of 600 mm based on a relatively low pressure ballast pump rated at 3,000 $m^3$/hr so as to nominally produce foam at the rate of approximately 6,900 $m^3$/hr at the deck at atmospheric pressure and again assuming the venturi injector 32 will educt roughly one-and-a-third times (1.3×) air to water in such a large waterborne vessel context. Again, the actual release point of the foam is the draft of the vessel, such as for example here for a larger tanker may be 8 m below the surface 14 when the vessel is in ballast and 13 m below the surface 14 when the vessel is in cargo. The pressure at 8 m of water is 1.8 atmospheres A (Absolute), so the 3,900 $m^3$ of air is now reduced due to the water pressure under the hull 12: 3,900 $m^3$/1.8=2,167 $m^3$. Adding the 3,000 $m^3$ of water, the total volume of foam produced and to be discharged is thus 5,167 $m^3$/hr with the vessel in ballast in this example. Whereas with the vessel in cargo with a nominal 13 m draft where the pressure is 2.3 atmospheres A (Absolute), it follows that the volume of air is 3,900 $m^3$/2.3=1,696 $m^3$ plus 3,000 $m^3$ of water or 4,696 $m^3$ total volume of foam produced and to be released under the hull 12 per hour. And taking the vessel speed in ballast to be 13 knots or 6.5 m/sec and the vessel speed in cargo to be 11 knots or 5.5 m/sec, it again follows that such would be the approximate velocities of foam discharge from the release slots 68 for a consistent relatively laminar flow across the bottom of the hull 12. With the average or nominal volume of foam produced and thus to be released in this example of 5,000 $m^3$/hr or about 1.4 $m^3$/sec and the average or nominal representative vessel speed being about 6 m/sec, it follows that the cross-sectional area of the release channels 60 through or across which such foam would be released at the desired rate of nominally 6 m/sec would be approximately 0.23 $m^2$ (1.4 $m^3$/sec/6 m/sec). For illustration and not limitation, once more there are shown four such release channels 60 and corresponding release slots 68 intersecting the hull 12 in the exemplary foam release apparatus 50 such that the cross-sectional area of each release channel 60 would then be roughly 0.06 $m^2$ (0.23 $m^2$/4). Accordingly, in the alternative exemplary embodiment of FIGS. 8-11, the profile of each release channel 60 may for example be rectangular with a width Y1 of approximately 1,000 mm and a height Y2 of approximately 60 mm. This again is a nominal profile or cross-section of each release channel 60, noting particularly as best seen in FIG. 9 that the alternative exemplary embodiment includes a release channel upper plate 62 that is at a different slope or angle S2 than the slope or angle S1 of the release channel lower plate 64, such that each release channel 60 is tapered in profile from its inlet within the chamber 52 to its outlet at the respective release slot 68. For example, assuming a roughly ten-degree (10°) slope or angle S1 of the release channel lower plate 64, the slope or angle S2 of the upper plate 62 may instead be twenty degrees (20°), so that the nominal slope or angle of the release channel 60 is then fifteen degrees (15°)((20°+10°)/2). Again, those skilled in the art will appreciate that a variety of such geometries and configurations of the foam release apparatus 50 including the angles of the release channels 60, or upper and lower plates 62, 64, are possible without departing from the spirit and scope of the invention, and specifically whether the release channels 60 are non-tapered or tapered, it being generally noted that by introducing the foam beneath the hull 12 at an angle to the hull 12, the foam would tend to flow along and form or become part of the boundary layer adjacent to the hull 12 versus punching through or otherwise disrupting such boundary layer, more about which is said below. Continuing with this alternative exemplary apparatus 50, the overall length L of the chamber 52 from the rear to the forward side plates 66 may be 4,000 mm and the lateral width W of the chamber 52 may be 7,000 mm, for example, and taking the width-wise or transverse profile of the chamber 52 to be rectangular as having an average height Y2 between the upper and lower plates 62, 64 of 60 mm and a length of three-fourths the overall length L of the chamber 52 or 3,000 mm to account for the aft portion of the chamber 52 generally comprising only the release channels 60 with gaps therebetween, and taking the width-wise or transverse dimension W of the chamber 52 to be 7,000 mm, it follows that the volume of the chamber 52 in this example is nominally 1,260,000,000 $mm^3$ (V=(60 mm×3,000 mm×7,000 mm), which translates to 1.26 $m^3$ or about 1,260 liters, roughly including the release channels 60 and somewhat accounting for the sloped upper and lower plates 62, 64 through averaging the height. It again will be appreciated that such volume of the release chamber 52 in the absolute sense or relative to the ALS 10 and particularly the size of the venturi injector 32 and return pipe 34 thus allows for conditioning of the foam pre-release from the chamber 52 and particularly the release slots 68 via the release channels 60. And continuing with the illustrative apparatus 50 sized as set forth above, the release channel 60 profile or cross-section as defined by the upper, lower, and side plates 62, 64, 66 may be nominally 1,000 mm in width Y1 and 60 mm in height Y2, with the upper and lower plates 62, 64 and thus the release channel 60 being at an angle S to the bottom of the hull 12, in this example again nominally of fifteen degrees (15°) though with the upper and lower plates 62, 64 being at different angles S1, S2, respectively, such that each release channel 60 is tapered toward the exit or release slot 68 and thus the length X of the release slot 68 is then approximately 60 mm in this example and is still nominally 1,000 mm wide, based on the slanted intersection of the release channel 60 with the hull 12. Once more, this is a bit of an over-simplification and is again based on illustrative round numbers as will be appreciated and understood by those skilled in the art. But for further illustration and not limitation, staying with the exemplary tanker and related ALS 10 for which a nominal volume of foam produced and thus to be released is approximately 5,000 $m^3$/hr or about 1.4 $m^3$/sec, it follows that here in this example with an approximate chamber or volume 52 size of 1.26 $m^3$, the dwell time of the foam is about one second or less. Again, those skilled in the art will appreciate that any such dwell time of the foam within the chamber or volume 52 may vary based on a number of factors, principally including but not limited to the size or volume of the chamber 52 itself or the space between the return pipe 34 and the release channels and slots 60, 68, such that the indicated approximately one second dwell of the foam within the chamber 52 prior to discharge is again to be understood as merely illustrative and non-limiting, and that indeed in other embodiments or contexts a dwell time of the foam of a second or more may be appropriate and the foam release apparatus 50 sized or scaled accordingly. The result as shown in both FIGS. 8 and 11 is a relatively uniform or consistent and even somewhat laminar discharge from the release slots 68 of air-water microbubbles 40 along the vessel hull 12. Once again, those skilled in the art will appreciate that a variety of other sizes and configurations of such a static or solid state foam release apparatus 50 according to aspects of the present invention may be employed based on a number of factors without departing from the spirit and scope of the invention, as will be further appreciated from the following alternative non-limiting example.

Figure 12:
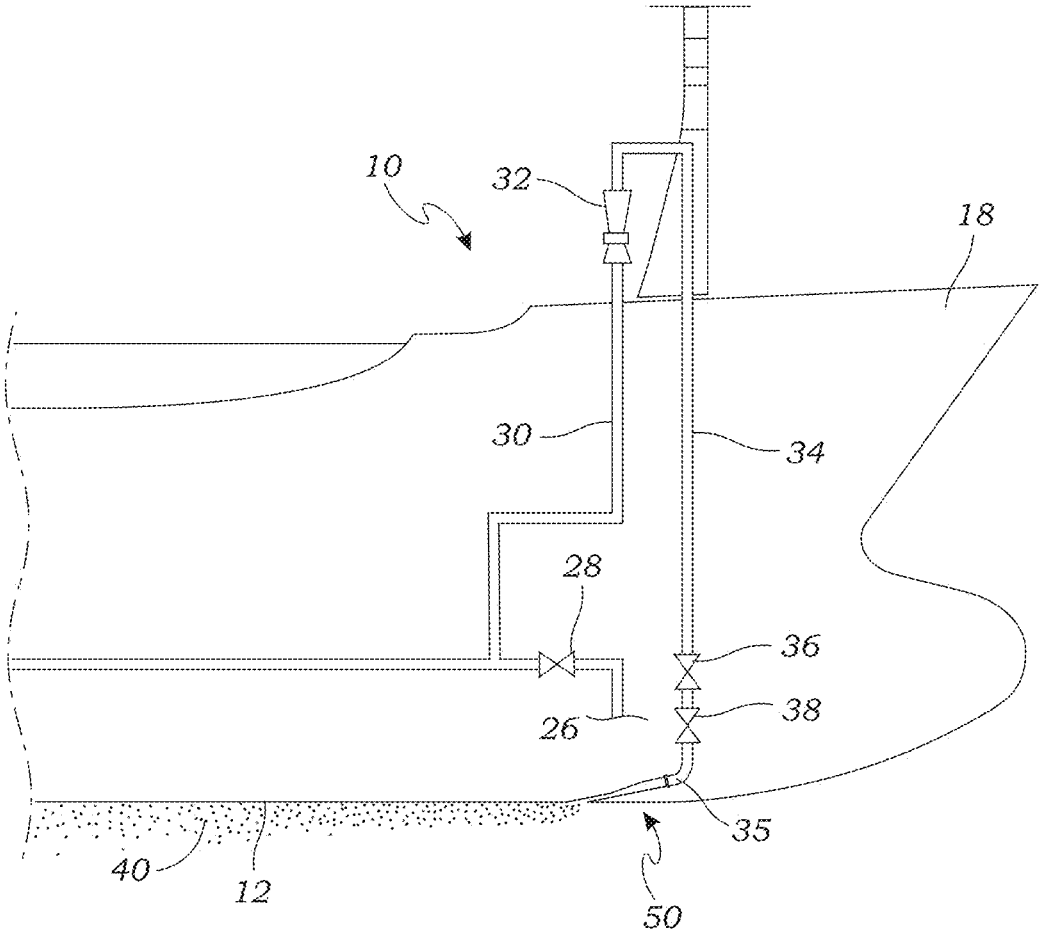
FIG. 12 is a partial side schematic view of an exemplary vessel equipped with a further alternative exemplary ALS foam release apparatus, in accordance with at least one embodiment.
Figure 13:
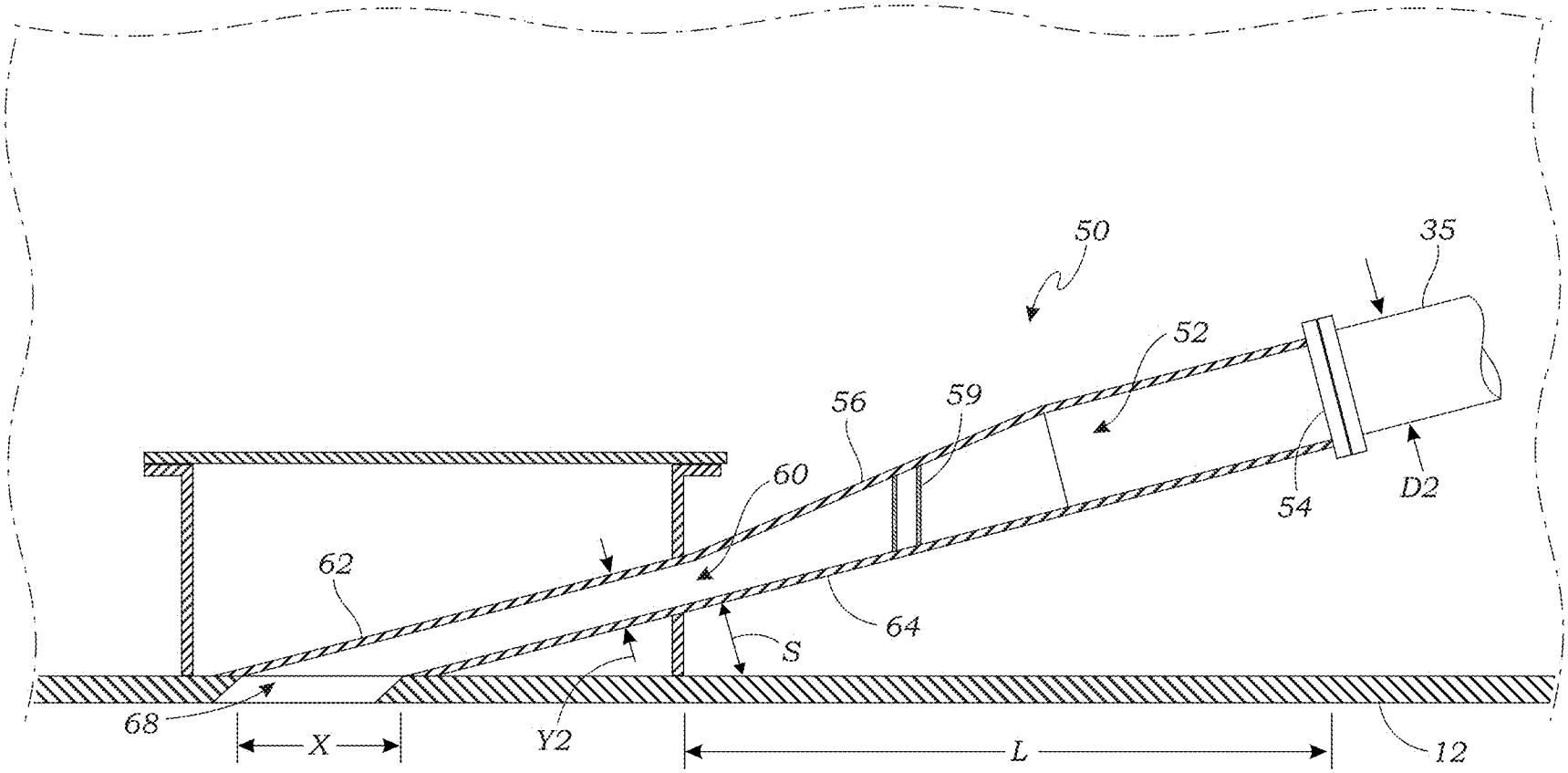
FIG. 13 is an enlarged partial side schematic view thereof, in accordance with at least one embodiment.
Figure 14:
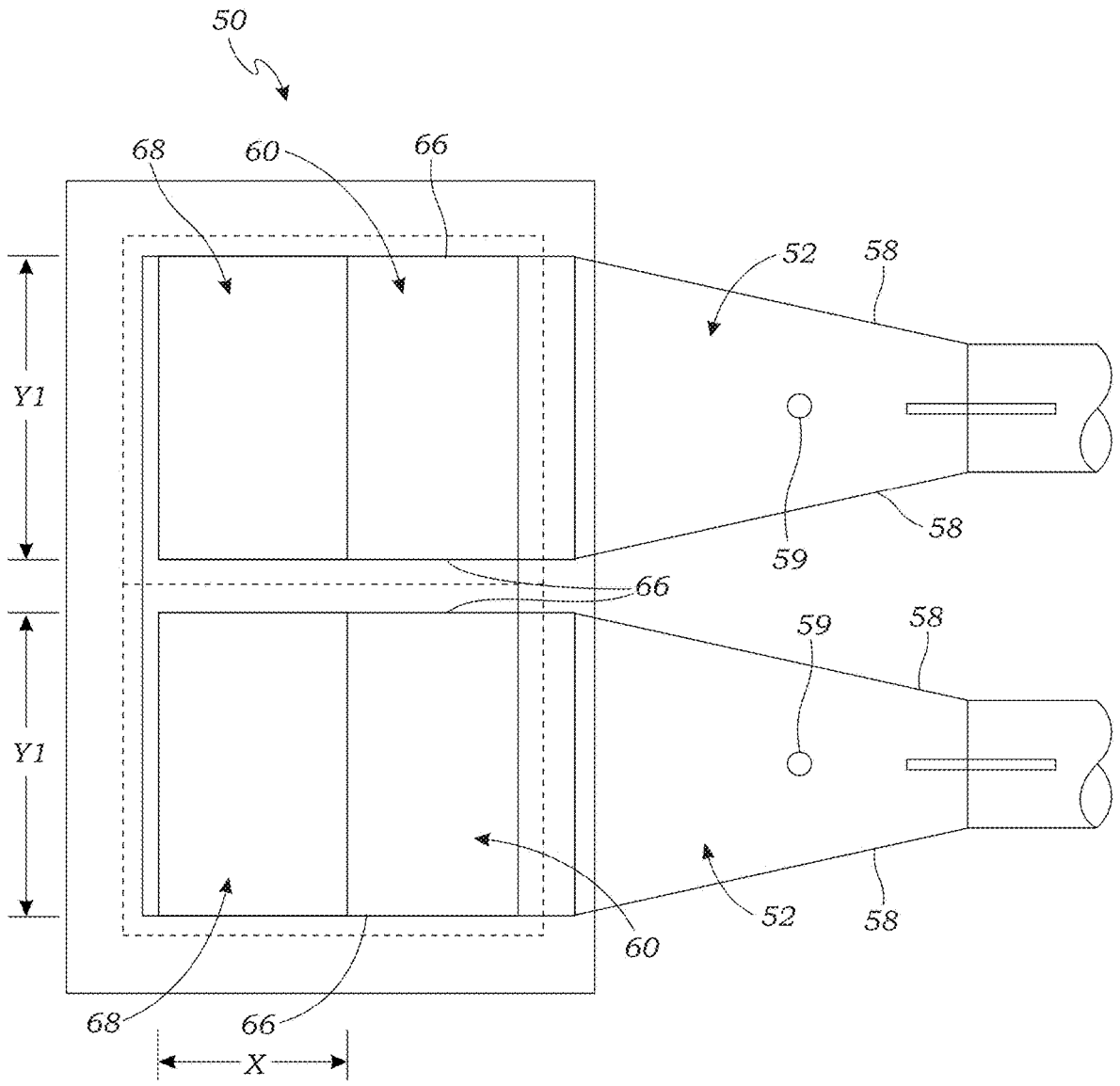
FIG. 14 is an enlarged partial top schematic view thereof, in accordance with at least one embodiment.
Figure 15:
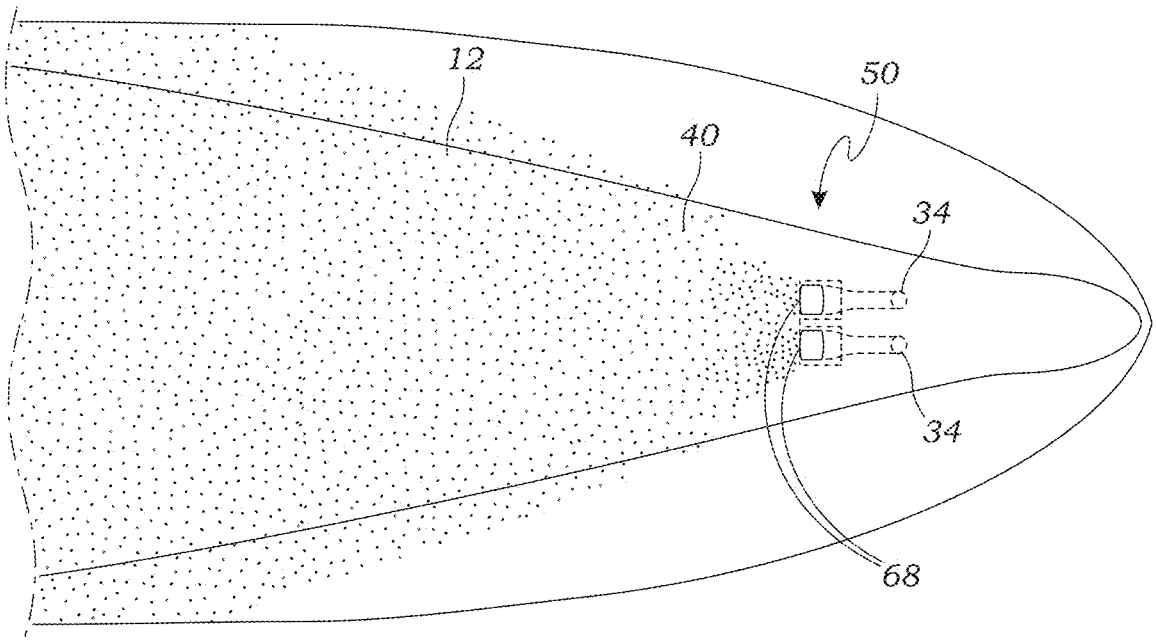
FIG. 15 is an enlarged partial bottom schematic view thereof, in accordance with at least one embodiment.

Referring next to FIGS. 12-15, there are shown partial side, top, and bottom schematic views of a further alternative exemplary embodiment of a foam release apparatus 50 according to aspects of the present invention as incorporated in an exemplary prior art air lubrication system or ALS 10 operationally installed on a vessel such as that disclosed in U.S. Pat. No. 10,315,729 to McPherson that is again to be understood as illustrative and non-limiting. The apparatus 50 once more comprises a chamber 52 intersected by and in fluid communication with the ALS return pipe 34, here the return pipe 34 including a bend close to the ship hull 12 transitioning to a pipe lower section 35 that is at an angle to the main return pipe 34 and is substantially aligned with the chamber 52 and the release channel 60 and specifically the lower plate 64 of the release channel 60 that is again contiguous with or spans both the chamber 52 and release channel 60, with the angled lower section 35 of the return 'pipe 34 thus serving to introduce foam from the ALS 10 via the return pipe 34 substantially in-line with the chamber 52 and the release channel 60 so as to further reduce any possibility of turbulence being induced in the foam flow. The overall perimeter of the chamber 52 is again bounded or defined at its bottom by the release channel lower plate 64 and vertically by opposite side walls 58. Above and opposite of the lower plate 64 an angled upper wall 56 spanning the opposite side walls 58 encloses the chamber 52. And as best seen in FIG. 14, the chamber side walls 58 are also angled relative to each other such that the chamber's cross-sectional profile is tapered from the chamber inlet 54 where the return pipe lower section 35 joins the chamber 52; specifically, in the direction of each release channel 60 the chamber 52 gets wider as it gets flatter due to the angled chamber upper wall 56 relative to the planar lower plate 64, such that it will be appreciated that the overall cross-sectional profile of the chamber 52 acts to condition and shape the foam as it flows to the release channels 60. As also seen in FIG. 14, in the exemplary embodiment there are two separate side-by-side chambers 52, one associated with each of two release channels 60, such that the foam flow slows and is split across the chambers 52. It will be appreciated that such split of the foam flow can be achieved anywhere upstream of the chambers 52 within the return pipe 34 as by a "Tee" or otherwise as schematically illustrated in FIG. 15, or may be achieved within a unitary single chamber 52 before being distributed across multiple release channels 60 as in the other exemplary embodiments of FIGS. 4-11. It is further noted that one or more hull shut off valves 36, 38 may be installed within each such possible "Tee'd" portion of the return pipe 34 and so be effectively "in parallel," rather than "in series" as shown in FIG. 12, and/or may be installed within the return pipe 34 upstream of any such "Tee," and in any case it will be appreciated that any number and arrangement of any such valves 36, 38 may be employed depending on a variety of factors or to suit a particular vessel context as dictated by Classification Society requirements or otherwise, such that the illustrated two valves 36, 38 "in series" is to be understood as exemplary and non-limiting. Regardless, an optional further feature within each release chamber 52 is a cross-post 59 to further encourage the spread or distribution of the foam within the chamber 52. A plurality of sloped release channels 60 are once again formed within the foam release apparatus 50, again here in the alternative exemplary embodiment one release channel 60 per chamber 52, each release channel 60 bounded or defined by its upper plate 62, not shown in FIG. 14 for simplicity, the lower plate 64, and the vertical side plates 66 and terminating in a respective release slot 68 formed in or intersecting the vessel hull 12 so as to fluidly communicate between the chamber 52 and the water 16 beneath the hull 12 via the release channels 60 and release slots 68 defining openings for the controlled release of foam from the chamber 52. Accordingly, it will again be appreciated that the gas or air bubble and water mixture or foam generated by the upstream venturi injector 32 that passes down through the return pipe 34, now including its angled lower section 35, to the foam release apparatus 50 and specifically the chamber 52 via its inlet 54 can then stabilize or be conditioned pre-release through a holding or dwell time within the chamber 52 before the foam then passes out of the chamber 52 in a relatively controlled manner through the release channels 60 and release slots 68 to the bottom of the hull 12 so as to form the desired air-water microbubble boundary layer 40 for reduced drag and improved vessel efficiency. Once more, it will be appreciated that such a foam release apparatus 50 according to aspects of the present invention can take a number of other forms and be scaled or sized to suit various ALS 10 and vessels without departing from the spirit and scope of the invention. By way of further illustration and not limitation, in an exemplary foam release apparatus 50 according to aspects of the present invention such as shown in FIGS. 12-15 as might be employed in connection with a vessel such as a car carrier roughly 200 m long having a gross tonnage of approximately 70,000, the return pipe 34 may have a nominal diameter D1 of 400 mm that then tees into two pipes each having a nominal diameter D2 of 250 mm including the lower section 35 with the volume of foam generated per hour at the deck level by the venturi injector 32 consisting of approximately 1,000 $m^3$ of water plus 1,200 $m^3$ of air or nominally a total of 2,200 $m^3$/h at atmospheric pressure. The release point of the foam is the draft of the vessel, such as 6 m below the surface 14 when the vessel is in ballast. The pressure at 6 m of water is again 1.6 atmospheres A (Absolute), so the 1,200 $m^3$ of air is now reduced due to the water pressure under the hull 12: 1,200/1.6=750 $m^3$. Adding the 1,000 $m^3$ of water and the total volume of foam produced and to be discharged is 1,750 $m^3$/hr. While in cargo the draft is nominally 10 m and thus the pressure of water is 2.0 atmospheres A (Absolute), so the volume of air is 1,200/2.0=600 $m^3$ plus 1,000 $m^3$ of water or 1,600 $m^3$ of foam produced per hour and to be released under the hull 12 per hour. And taking the vessel speed in ballast to be 16 knots or 8 m/sec and the vessel speed in cargo to be 14 knots or 7 m/sec, it follows that such would be the approximate velocities at which the foam would be released from the release slots 68 for a consistent relatively laminar flow across the bottom of the vessel hull 12. Taking the average or nominal volume of foam produced and thus to be released in this example to be 1,675 $m^3$/hr or about 0.46 $m^3$/sec and the average or nominal representative vessel speed being about 7.5 m/sec, it follows that the cross-sectional area of the release channels 60 through or across which such foam would be released at the desired rate of nominally 7.5 m/sec would be approximately 0.061 $m^2$ (0.46 $m^3$/sec/7.5 m/sec). For further illustration and not limitation, once more there are shown in FIG. 14 two such release channels 60 and corresponding release slots 68 intersecting the hull 12 in the exemplary foam release apparatus 50 such that the cross-sectional area of each release channel 60 would then be roughly 0.03 $m^2$ (0.06 $m^2$/2). Accordingly, in the further alternative exemplary embodiment of FIGS. 12-15, the profile of each release channel 60 may for example be rectangular with a width Y1 of approximately 500 mm and a height Y2 of approximately 60 mm, which equates to 30,000 $mm^2$ or 0.03 $m^2$. Those skilled in the art will once again appreciate that a variety of such geometries and configurations of the foam release apparatus 50 including the angle of the release channels 60, or particularly the lower plate, are possible without departing from the spirit and scope of the invention, and specifically whether the release channels 60 are non-tapered as shown here or are tapered as in other exemplary embodiments, it being generally noted once more that by introducing the foam beneath the hull 12 at an angle to the hull 12, the foam would tend to flow along and form or become part of the boundary layer adjacent to the hull 12 versus punching through or otherwise disrupting such boundary layer. Continuing with this further alternative exemplary apparatus 50, the overall length L of the chamber 52 from its inlet 54 to the transition into the respective release channel 60 may be approximately 1,500 mm, which it will be appreciated includes along its length both an annular pipe section at the chamber inlet 54 as coupled to the return pipe lower section 35 and a flattened and tapered transition chute region defined by the contiguous lower plate 64 below, the opposite angled upper wall 56 above, and the opposite angled side walls 58 joining the upper wall 56 to the lower plate 64. More particularly, then, for the annular portion of each chamber 52, the length may be approximately 700 mm and its diameter again is 250 mm corresponding to the return pipe 34, such that the volume is approximately 34,000,000 $mm^3$ ($V=(\pi\times(250\ mm/2)^2\times700\ mm)$, which translates to 0.034 $m^3$ or about 34 liters. And for the flattened and tapered chute portion, the length may be approximately 800 mm, the height may be approximately 155 mm ((250 mm+60 mm)/2), and the lateral width may be approximately 375 mm ((250 mm+500 mm)/2), such that the volume of each is nominally 46,000,000 $mm^3$ ($V=(800\ mm\times155\ mm\times375\ mm)$, which translates to 0.046 $m^3$ or about 46 liters. It follows, then, that the total volume of the chamber 52 is approximately 0.16 $m^3$ ($(0.034\ m^3+0.046\ m^3)\times2$) or about 160 liters. It again will be appreciated that such volume of the release chamber 52 in the absolute sense or relative to the ALS 10 and particularly the size of the venturi injector 32 and return pipe 34 thus allows for minimal conditioning of the foam pre-release from the chamber 52 and particularly the release slots 68 via the release channels 60 or is instead configured for somewhat of a steady state throughput. And continuing with the illustrative apparatus 50 sized as set forth above, the release channel 60 profile or cross-section as defined by the upper, lower, and side plates 62, 64, 66 may again be nominally 500 mm in width Y1 and 60 mm in height Y2, with the upper and lower plates 62, 64 and thus the release channel 60 being at an angle S to the bottom of the hull 12, in this example again nominally of fifteen degrees (15°) such that the length X of the release slot 68 is then approximately 300 mm in this example and is still nominally 500 mm wide, based on the slanted intersection of the release channel 60 with the hull 12. Once more, this is a bit of an over-simplification and is again based on illustrative round numbers as will be appreciated and understood by those skilled in the art. But for further illustration and not limitation, staying with the exemplary car carrier vessel and related ALS 10 for which a nominal volume of foam produced and thus to be released is approximately 1,675 $m^3$/hr or about 0.46 $m^3$/sec, it follows that here in this example with an approximate volume of the chamber 52 of 0.16 $m^3$, the dwell time of the foam is under one second or closer to about 0.3 second. Again, those skilled in the art will appreciate that any such dwell time of the foam within the chamber or volume 52 may vary based on a number of factors, principally including but not limited to the size or volume of the chamber 52 itself or the space between the return pipe 34 and the release channels and slots 60, 68, such that the indicated approximately one-third second dwell of the foam within the chamber 52 prior to discharge is again to be understood as merely illustrative and non-limiting, and that indeed in other embodiments or contexts a dwell time of the foam of a second or more may once again be appropriate and the foam release apparatus 50 sized or scaled accordingly. Furthermore, the foregoing regarding any dwell versus a steady somewhat laminar throughput of foam and the resulting more controlled release of foam beneath the vessel hull 12 from the release slots 68 does not account for other physical and fluid dynamics factors at work within the apparatus 50 such as frictional effects and of course includes approximations based on vessel size, speed, draft, etc. Regardless, the result as shown in both FIGS. 12 and 15 is a relatively uniform or consistent and even somewhat laminar release or discharge from the release slots 68 of air-water microbubbles 40 along the vessel hull 12, which is further contributed to once more by the angle of the release channels 60 and here even of the aligned bent lower section 35 of the return pipe 34, which angle S of the lower plate 64 and thus of the release channels 60 may again be approximately ten to twenty degrees (10-20°). Once again, those skilled in the art will appreciate that a variety of other sizes and configurations of such a static or solid state foam release apparatus 50 according to aspects of the present invention may be employed based on a number of factors without departing from the spirit and scope of the invention, as will be appreciated from the other non-limiting examples discussed above.

Following the foregoing illustrative discussion of exemplary foam release apparatuses 50 according to aspects of the present invention, it will be appreciated that the cross-sectional area of the release channel 60 and its slope or gradient are defining components of the foam release apparatus 50 and its performance in introducing a relatively smooth and steady flow of foam to the bottom of the vessel hull 12, versus shooting out more intermittently or irregularly or agglomerating prior to release (in a sense, belching), with the release chamber 52 and its release channels 60 effectively configured to move the foam from the return pipe 34 to the release slots 68 at a controlled relatively uniform velocity with minimal turbulence or preference between outlets or release channels 60 and slots 68 (if multiple outlets). The volume of foam produced is a function of the driving pump and vessel draught, while the quality of the foam is a function of salt or fresh water and form of the venturi injector. Particularly, sizing of the return pipe 34, which is generally a standard size pipe or pipes that match or are larger in cross-section than the venturi injector 32, is determined by the quality and quantity of foam generated by the foam generation unit, or venturi injector 32 in this example, the type of water generating the foam, the layout/pathway and geometry of the return pipe 34, and the characteristics, operational and physical, of the vessel the ALS 10 is installed on. Sizing of the return pipe 34 should allow the foam generation unit or venturi injector 32 to work without undue incumbrances (back pressure) and ensure the foam retains the correct quality for effective use in the ALS 10, regarding which the size and configuration of the downstream foam release apparatus 50 is also a factor, and vice versa, with incorrect relative sizing between the return pipe 34 and the foam release apparatus 50 potentially leading to incorrect flow characteristics in the foam release apparatus 50. Generally, the return pipe 34 should allow for a foam velocity of between 3 and 12 m/s, potentially in approximate match with the operational characteristics, velocity, draft, etc. of different vessel types and thus foam discharge from the foam release apparatus 50 via the release channels 60 and slots 68 according to aspects of the present invention.

As mentioned previously, by introducing the foam beneath the hull 12 at an angle to the hull 12 due to the geometry of the release channels 60 and slots 68, the foam would tend to flow along and form or become part of the boundary layer adjacent to the hull 12 versus punching through or otherwise disrupting such boundary layer. Particularly, the vertical velocity of foam being released from the foam release apparatus 50 will primarily be defined by the aftward slope of the release channels 60. To some extent this will also be influenced by vessel structure. A gradient of 20-30% or roughly 10-20° will be shallow enough to reduce the vertical velocity of the foam to the point it does not punch through the boundary layer. At this angle, the foam, if introduced at the right aft velocity as set forth herein as somewhat approximating the vessel's representative velocity, will be able to establish itself as a lighter than water layer against the hull per the illustrated air-water microbubbles 40 along the vessel hull 12. The gradient being 20-30% will also not cause the fore-aft opening in the hull 12 to be too extensive, which of course is important for structural and cost of installation reasons. And the cross-section or profile of the release channels 60 being relatively uniform even if tapered and each having a minimum length of 500 mm will help to establish a laminar flow for the foam before it is released beneath the hull 12 into the boundary layer, again reducing turbulence. The length of the release channels 60 will be influenced by the velocity of the vessel and so the target velocity of the foam (to approximate that of the vessel), with it again being generally noted that commercial vessels big and small tend to travel between 10 and 15 knots while larger container vessels may travel between 18 and 24 knots, for example, while all such applications as well as the onboard ALS 10 of any such vessel again being accommodated by simply appropriately scaling the respective foam release apparatus 50 according to aspects of the present invention. Accordingly, aspects of the present invention are directed to the geometry or configuration of the static or steady state foam release apparatus 50 downstream of the venturi injector 32 in tuning or "right sizing" the apparatus 50 relative to the ALS 10 for optimal foam discharge from the hull outlets 60, 68, or essentially having the rate of release of the foam somewhat match the expected representative speed of the vessel and the angle of release of the foam be more along the bottom of the vessel, resulting in a relatively more laminar foam release, again directly into the boundary layer so as to improve or reduce the friction of any such boundary layer. This method of specifically determining the depth, width, and length of the release apparatus 50 in general and each release channel 60 in particular for a particular vessel and ALS installation (where bubbles are generated before discharge of air from the hull) allows relatively large volumes of foam to be discharged from relatively limited hull penetrations in terms of number and size. In Johannesson the hull penetrations or cavities achieve bubble generation but by design are fully open to the water beneath the hull and shaped to create turbulence or mixing of water with the introduced compressed air within each cavity and so have to be numerous because only a relatively small volume or thickness of bubbles can be generated from each relatively very large hull penetration cavity. And in Armson the multiple sources of air and water are controlled and either driven or "active" or "passive" and result in numerous hull penetrations for discharge across the beam of the vessel. In contrast, in the relatively simple solid state foam release apparatus 50 according to aspects of the present invention the discharged layer of foam is sufficiently thick to spread across the hull from limited outlets in the hull. This fundamental difference provides significant commercial and operational advantages. Installation is relatively simple, using fractional engineering, design, materials, and labor to support the hull penetrations required by the ALS (to maintain hull strength there are very strict rules governing vessel structures and hull penetrations that call for significant design study and engineering of reinforcement around any hull penetration, which must all be independently reviewed and approved by the Classification Society of the vessel). Also, employing limited penetrations within a relatively small hull surface area, the present system detracts from vessel performance far less if the ALS is not in use as compared to Johannesson and Armson. This is so much of an issue doors are considered on some ALS outlets for selectively closing the ALS outlets when the system is not in use, further adding to the cost, installation, and operational/maintenance burden of the system. The minimal installation burden of the present foam release apparatus 50 results in a fractional (CAPEX) installation cost (e.g., 20-25%) relative to other air lubrication systems.

It will be further appreciated that any and all such components of the foam release apparatus 50 may be formed of any suitable material, such as metal or plastic, through any suitable fabrication process, such as molding, casting, machining, welding, stamping, or forming, whether now known or later developed, and may be formed integrally or may be formed separately and then assembled in any appropriate secondary operation employing any assembly technique now known or later developed, including but not limited to fastening, riveting, bolting, bonding, welding, over-molding or coining, or any other such technique now known or later developed. Once again, it will be appreciated by those skilled in the art that a variety of geometries and configurations of a foam release apparatus 50 according to aspects of the present invention, including but not limited to the release channels 60 and the release slots 68, both in form and number, are possible according to aspects of the present invention without departing from its spirit and scope.

Aspects of the present specification may also be described as the following numbered embodiments:

1. A foam release apparatus for discharging foam formed within an air lubrication system of a water-borne vessel having a hull, the air lubrication system configured to form the foam at a foam volumetric flow rate adjusted for vessel draft and to deliver the pre-formed foam to the apparatus via a return pipe, and the vessel configured to travel through the water at a representative vessel speed, the apparatus comprising: a chamber in fluid communication with the return pipe at a chamber inlet; and a release channel in fluid communication with the chamber and oppositely with a release slot formed by the intersection of the release channel with the hull so as to define an opening in the hull configured for discharge of foam delivered through the return pipe into the chamber and out of the chamber through the release channel and the release slot into the water beneath the hull, the release channel formed having a lower plate at an angle to the hull, wherein a cross-sectional area of the release channel corresponds to the foam volumetric flow rate adjusted for vessel draft divided by the representative vessel speed, further wherein the discharge of foam beneath the vessel through the release slot is along the hull and forms a reduced-friction boundary layer between the hull and the water due to the angle of the lower plate and the cross-sectional area of the release channel and the rate of foam discharge corresponding to the representative vessel speed without the need for any control system-based operation, and further wherein the chamber is not exposed to the opening in the hull and the water beneath the hull due to the configuration of the release channel and release slot and the discharge of foam that is pre-formed within the air lubrication system upstream of the apparatus and delivered to the apparatus via the return pipe.

2. The apparatus of embodiment 1 wherein the angle of the lower plate of the release channel to the hull is in the range of ten to twenty degrees.

3. The apparatus of embodiment 1 or embodiment 2 wherein the angle of the lower plate of the release channel to the hull is fifteen degrees.

4. The apparatus of any of embodiments 1-3 comprising a plurality of release channels and corresponding release slots, wherein a total cross-sectional area of the release channels corresponds to the foam volumetric flow rate adjusted for vessel draft divided by the representative vessel speed.

5. The apparatus of embodiment 4 comprising two release channels and corresponding release slots.

6. The apparatus of embodiment 5 comprising two chambers, one chamber associated with each release channel.

7. The apparatus of embodiment 4 comprising four release channels and corresponding release slots.

8. The apparatus of any of embodiments 4-7 wherein the total cross-sectional area of the release channels is in the range of 0.01 $m^2$ to 0.5 $m^2$.

9. The apparatus of any of embodiments 4-8 wherein the total cross-sectional area of the release slots is in the range of 0.01 $m^2$ to 2 $m^2$.

10. The apparatus of any of embodiments 1-9 wherein a cross-sectional area of the release slot is the same as or greater than the cross-sectional area of the release channel due to the angle of the lower plate of the release channel.

11. The apparatus of any of embodiments 1-10 wherein the release channel comprises an upper plate opposite of the lower plate and opposite side plates connecting the upper and lower plates to form the enclosed release channel communicating between the chamber and the release slot.

12. The apparatus of embodiment 11 wherein the upper plate is parallel to the lower plate.

13. The apparatus of embodiment 11 wherein the upper plate is at an angle to the lower plate so that the release channel is tapered from the chamber to the release slot.

14. The apparatus of any of embodiments 11-13 wherein the side plates are parallel.

15. The apparatus of any of embodiments 1-14 wherein the chamber is formed having an upper wall and at least one side wall that together with effectively the lower plate of the release channel define a chamber volume.

16. The apparatus of embodiment 15 wherein the ratio of the chamber volume to the foam volumetric flow rate adjusted for vessel draft is one or greater such that the chamber volume allows the foam entering the chamber from the return pipe through the inlet to dwell within the chamber for at least one second before passing out of the chamber through the release channel.

17. The apparatus of embodiment 15 wherein the ratio of the chamber volume to the foam volumetric flow rate adjusted for vessel draft is less than one such that the chamber volume allows the foam entering the chamber from the return pipe through the inlet to pass directly out of the chamber through the release channel and thus to dwell within the chamber for less than one second.

18. The apparatus of any of embodiments 15-17 wherein the chamber volume is in the range of 0.1 $m^3$ to 2 $m^3$.

19. The apparatus of any of embodiments 15-18 wherein the inlet is formed in the chamber upper wall opposite of the release channel.

20. The apparatus of any of embodiments 15-19 wherein the inlet is perpendicular to the lower plate of the release channel, whereby the return pipe has a lower section that is parallel to the lower plate of the release channel.

21. The apparatus of any of embodiments 15-20 wherein at least one of the chamber upper wall and side wall is curved.

22. The apparatus of any of embodiments 15-21 wherein at least a portion of the chamber upper wall is at an angle to the lower plate so that the chamber is tapered vertically between the chamber inlet and the release channel.

23. The apparatus of any of embodiments 15-22 wherein the chamber is formed having opposite side walls at an angle to each other so that the chamber is tapered horizontally between the chamber inlet and the release channel.

24. The apparatus of any of embodiments 15-23 wherein a cross-post extends into the chamber from the chamber upper wall.

25. The apparatus of any of embodiments 1-24 wherein the foam volumetric flow rate adjusted for vessel draft is based on the vessel in cargo.

26. The apparatus of any of embodiments 1-24 wherein the foam volumetric flow rate adjusted for vessel draft is based on the vessel in ballast.

27. The apparatus of any of embodiments 1-24 wherein the foam volumetric flow rate adjusted for vessel draft is based on an average of the vessel in cargo and the vessel in ballast.

28. The apparatus of any of embodiments 1-27 wherein the representative vessel speed is based on the vessel in cargo.

29. The apparatus of any of embodiments 1-27 wherein the representative vessel speed is based on the vessel in ballast.

30. The apparatus of any of embodiments 1-27 wherein the representative vessel speed is based on an average of the vessel in cargo and the vessel in ballast.

31. The apparatus of any of embodiments 1-30 wherein the air lubrication system includes a venturi injector.

32. A method of employing a foam release apparatus as defined in any one of embodiments 1-31, the method comprising the steps of: determining a foam volumetric flow rate at atmospheric conditions for the air lubrication system; determining the foam volumetric flow rate adjusted for vessel draft based on the vessel from the foam volumetric flow rate at atmospheric conditions; determining the representative vessel speed for the vessel; and determining the cross-sectional area of the release channel based on the foam volumetric flow rate adjusted for vessel draft divided by the representative vessel speed.

33. The method of embodiment 32 further comprising the step of configuring the foam release apparatus with one or more release channels together having the determined release channel cross-sectional area.

34. The method of embodiment 32 or embodiment 33 further comprising the steps of: forming a release slot in the hull corresponding to each release channel; and installing the foam release apparatus within the vessel adjacent to the hull with the chamber in fluid communication with the return pipe via the chamber inlet and each release channel in fluid communication with the respective release slot.

35. The method of embodiment 34 wherein the step of configuring the foam release apparatus with one or more release channels comprises forming each release channel with a lower plate at an angle to the vessel hull and intersecting the respective release slot.

36. The method of embodiment 35 wherein the step of installing the foam release apparatus within the vessel comprises aligning a lower section of the return pipe with the respective lower plate.

37. The method of any of embodiments 32-36 wherein the step of determining the foam volumetric flow rate adjusted for vessel draft is based on the vessel in cargo.

38. The method of any of embodiments 32-36 wherein the step of determining the foam volumetric flow rate adjusted for vessel draft is based on the vessel in ballast.

39. The method of any of embodiments 32-36 wherein the step of determining the foam volumetric flow rate adjusted for vessel draft is based on the average of the vessel in cargo and the vessel in ballast.

40. The method of any of embodiments 32-39 wherein the step of determining the representative vessel speed is based on the vessel in cargo.

41. The method of any of embodiments 32-39 wherein the step of determining the representative vessel speed is based on the vessel in ballast.

42. The method of any of embodiments 32-41 wherein the step of determining the representative vessel speed is based on the average of the vessel in cargo and the vessel in ballast.

43. The method of any of embodiments 32-42 comprising the further step of determining a volume of the chamber based on the determined foam volumetric flow rate adjusted for vessel draft and the determined release channel cross-sectional area and further based on a desired foam dwell within the chamber from the time the foam enters the chamber to the time it passes out of the chamber into the one or more release channel.

In closing, regarding the exemplary embodiments of the present invention as shown and described herein, it will be appreciated that a foam release apparatus is disclosed and configured for operational installation on a waterborne vessel in conjunction with the vessel's air lubrication system ("ALS") downstream of the venturi injector or foam generating unit and sized relative to the ALS for optimal foam discharge from the hull outlets, or essentially having the rate of release of the foam somewhat match the expected speed of the vessel and the angle of release of the foam be more along the bottom of the vessel, resulting in a relatively more laminar foam release so as to improve the operation of the ALS. Because the principles of the invention may be practiced in a number of configurations beyond those shown and described, it is to be understood that the invention is not in any way limited by the exemplary embodiments, but instead may take numerous forms based on a variety of factors without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of components or ingredients, properties such as dimensions, weight, concentration, reaction conditions, and so forth, used to describe and claim certain embodiments of the inventive subject matter are to be understood as being modified in some instances by terms such as "about," "approximately," or "roughly." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in any specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators-such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with any appended claims here or in any patent application claiming the benefit hereof, and it is made clear that the inventor(s) believe that the claimed subject matter is the invention.

What is claimed is:

1. A foam release apparatus for discharging foam formed within an air lubrication system of a water-borne vessel having a hull, the air lubrication system configured to form the foam at a foam volumetric flow rate adjusted for vessel draft and to deliver the pre-formed foam to the apparatus via a return pipe, and the vessel configured to travel through the water at a representative vessel speed, the apparatus comprising:

a chamber in fluid communication with the return pipe at a chamber inlet; and a release channel in fluid communication with the chamber and oppositely with a release slot formed by the intersection of the release channel with the hull so as to define an opening in the hull configured for discharge of foam delivered through the return pipe into the chamber and out of the chamber through the release channel and the release slot into the water beneath the hull, the release channel formed having a lower plate at an angle to the hull, wherein a cross-sectional area of the release channel corresponds to the foam volumetric flow rate adjusted for vessel draft divided by the representative vessel speed, further wherein the discharge of foam beneath the vessel through the release slot is along the hull and forms a reduced-friction boundary layer between the hull and the water due to the angle of the lower plate and the cross-sectional area of the release channel and the rate of foam discharge corresponding to the representative vessel speed without the need for any control system-based operation, and further wherein the chamber is not exposed to the opening in the hull and the water beneath the hull due to the configuration of the release channel and release slot and the discharge of foam that is pre-formed within the air lubrication system upstream of the apparatus and delivered to the apparatus via the return pipe.

2. The apparatus of claim 1 wherein the angle of the lower plate of the release channel to the hull is in the range of ten to twenty degrees.

3. The apparatus of claim 1 comprising a plurality of release channels and corresponding release slots, wherein a total cross-sectional area of the release channels corresponds to the foam volumetric flow rate adjusted for vessel draft divided by the representative vessel speed.

4. The apparatus of claim 3 wherein the total cross-sectional area of the release channels is in the range of 0.01 $m^2$ to 0.5 $m^2$.

5. The apparatus of claim 4 wherein a total cross-sectional area of the release slots is in the range of 0.01 $m^2$ to 2 $m^2$.

6. The apparatus of claim 1 wherein a cross-sectional area of the release slot is the same as or greater than the cross-sectional area of the release channel due to the angle of the lower plate of the release channel.

7. The apparatus of claim 1 wherein the release channel comprises an upper plate opposite of the lower plate and opposite side plates connecting the upper and lower plates to form the enclosed release channel communicating between the chamber and the release slot.

8. The apparatus of claim 7 wherein the upper plate is parallel to the lower plate.

9. The apparatus of claim 7 wherein the upper plate is at an angle to the lower plate so that the release channel is tapered from the chamber to the release slot.

10. The apparatus of claim 1 wherein the chamber is formed having an upper wall and at least one side wall that together with effectively the lower plate of the release channel define a chamber volume.

11. The apparatus of claim 10 wherein the ratio of the chamber volume to the foam volumetric flow rate adjusted for vessel draft is less than one such that the chamber volume allows the foam entering the chamber from the return pipe through the inlet to pass directly out of the chamber through the release channel and thus to dwell within the chamber for less than one second.

12. The apparatus of claim 10 wherein the inlet is perpendicular to the lower plate of the release channel, whereby the return pipe has a lower section that is parallel to the lower plate of the release channel.

13. The apparatus of claim 10 wherein a cross-post extends into the chamber from the chamber upper wall.

14. The apparatus of claim 1 wherein the foam volumetric flow rate adjusted for vessel draft is based on one or more of the vessel in cargo and the vessel in ballast.

15. The apparatus of claim 1 wherein the air lubrication system includes a venturi injector.

16. A method of employing the foam release apparatus of claim 1, the method comprising the steps of:

determining the foam volumetric flow rate at atmospheric conditions for the air lubrication system;

determining the foam volumetric flow rate adjusted for vessel draft based on the vessel from the foam volumetric flow rate at atmospheric conditions;

determining the representative vessel speed for the vessel; and determining the cross-sectional area of the release channel based on the foam volumetric flow rate adjusted for vessel draft divided by the representative vessel speed.

17. The method of claim 16, further comprising the step of configuring the foam release apparatus with one or more release channels together having the determined release channel cross-sectional area.

18. The method of claim 17 further comprising the steps of:

forming a release slot in the hull corresponding to each release channel; and installing the foam release apparatus within the vessel adjacent to the hull with the chamber in fluid communication with the return pipe via the chamber inlet and each release channel in fluid communication with the respective release slot.

19. The method of claim 18 wherein the step of configuring the foam release apparatus with one or more release channels comprises forming each release channel with a lower plate at an angle to the vessel hull and intersecting the respective release slot.

20. The method of claim 16 comprising the further step of determining a volume of the chamber based on the determined foam volumetric flow rate adjusted for vessel draft and the determined release channel cross-sectional area and further based on a desired foam dwell within the chamber from the time the foam enters the chamber to the time it passes out of the chamber into the one or more release channel.

* * * * *